US008186799B2

(12) United States Patent
Morino et al.

(10) Patent No.: US 8,186,799 B2
(45) Date of Patent: May 29, 2012

(54) IMAGE FORMING APPARATUS AND IMPACT POSITION DISPLACEMENT CORRECTION METHOD

(75) Inventors: Tetsu Morino, Kanagawa (JP); Noboru Sawayama, Kanagawa (JP); Kenichi Kawabata, Kanagawa (JP); Mamoru Yorimoto, Tokyo (JP); Tetsuro Hirota, Kanagawa (JP); Takumi Hagiwara, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 1062 days.

(21) Appl. No.: 12/047,949

(22) Filed: Mar. 13, 2008

(65) Prior Publication Data

US 2008/0225067 A1 Sep. 18, 2008

(30) Foreign Application Priority Data

Mar. 17, 2007 (JP) ..... 2007-069681

(51) Int. Cl.
*B41J 29/393* (2006.01)

(52) U.S. Cl. ..... 347/19; 347/14

(58) Field of Classification Search ..... None
See application file for complete search history.

(56) References Cited

U.S. PATENT DOCUMENTS

| | | | | |
|---|---|---|---|---|
| 4,644,372 | A | 2/1987 | Hirota | |
| 4,661,822 | A | 4/1987 | Hirota et al. | |
| 5,270,103 | A * | 12/1993 | Oliver et al. | 428/219 |
| 5,353,052 | A * | 10/1994 | Suzuki et al. | 347/19 |
| 5,600,350 | A * | 2/1997 | Cobbs et al. | 347/19 |
| 5,754,202 | A | 5/1998 | Sekiya et al. | |
| 5,818,482 | A | 10/1998 | Ohta et al. | |
| 5,821,953 | A | 10/1998 | Nakano et al. | |
| 6,053,597 | A | 4/2000 | Hirota | |
| 6,331,052 | B1 | 12/2001 | Murai et al. | |
| 7,086,715 | B2 * | 8/2006 | Yamada | 347/19 |
| 2004/0141022 | A1 * | 7/2004 | Morimoto | 347/19 |
| 2005/0194730 | A1 | 9/2005 | Nishida et al. | |

FOREIGN PATENT DOCUMENTS

| | | |
|---|---|---|
| JP | 4-39041 | 2/1992 |
| JP | 5-249787 | 9/1993 |
| JP | 11-48587 | 2/1999 |
| JP | 2002-337415 | 11/2002 |

(Continued)

OTHER PUBLICATIONS

Sep. 13, 2011 Japanese official action in connection with a counterpart Japanese patent application.

*Primary Examiner* — Uyen Chau N Le
*Assistant Examiner* — Chad Smith
(74) *Attorney, Agent, or Firm* — Cooper & Dunham LLP

(57) ABSTRACT

An image forming apparatus is provided with a carriage in which recording heads having nozzles for ejecting liquid droplets are mounted and is configured to form an image on a recording medium being transported. The image forming apparatus includes a pattern forming unit that forms an impact position displacement adjustment pattern formed of plural independent liquid droplets on a water repellent member; a reading unit that includes a light emitting unit for emitting light onto the adjustment pattern and a light receiving unit for receiving specular reflection light from the adjustment pattern; and an impact position correcting unit that corrects an impact position of a liquid droplet to be ejected from the recording head based on a read result by the reading unit. The reading unit is disposed on the carriage and is arranged close to the side of a guide member that guides movement of the carriage.

11 Claims, 42 Drawing Sheets

FOREIGN PATENT DOCUMENTS

| | | |
|---|---|---|
| JP | 2005-81569 | 3/2005 |
| JP | 2005-103834 | 4/2005 |
| JP | 2005-342899 | 12/2005 |
| JP | 2006-123479 | 5/2006 |
| JP | 2006-178396 | 7/2006 |
| JP | 3838251 | 8/2006 |

* cited by examiner

IMAGE FORMING APPARATUS AND IMPACT POSITION DISPLACEMENT CORRECTION METHOD

BACKGROUND

1. Technical Field

This disclosure relates to an image forming apparatus including a recording head that ejects a liquid droplet; and a method for correcting a displacement of the impact position of a liquid droplet to be ejected from the recording head.

2. Description of the Related Art

Image forming apparatuses (e.g. printers, fax machines, copiers, and multifunction machines having functions of these machines) are known that perform image formation by ejecting a liquid (a recording liquid) such as ink onto a medium with use of, e.g., a liquid ejection device while transporting the sheet. The liquid ejection device comprises a recording head including a liquid ejection head (liquid droplet ejection head) for ejecting a droplet of the recording liquid (ink). It is to be noted that the term "medium" as used herein is hereinafter also referred to as a "sheet", which may be paper or may be made of other materials. The terms "to-be-recorded medium", "recording medium", "transfer material", and "recording sheet", may be used as synonyms. The terms "recording", "printing", and "imaging" may be used as synonyms for the term "image formation".

The term "image forming apparatus" as used herein indicates an apparatus that forms images by ejecting liquid onto media such as paper, strings, fibers, cloth, leather, metal, plastic, glass, wood, and ceramics. The term "image formation" as used herein indicates not only forming images that have meanings, such as characters and figures, on a medium, but also forming images that do not have meanings, such as patterns, on a medium. The image forming apparatus may include a textile printing apparatus and an apparatus for printing interconnects. The term "liquid" as used herein is not limited to recording liquid, but includes any liquid that can be used for image formation.

A problem with such a liquid ejection type image forming apparatus, especially one that reciprocates a carriage with a recording head for ejecting liquid droplets to print images in opposite printing directions, i.e., in the forward path and the backward path, when the apparatus draws images such as a ruled line, a ruled line drawn by the head moving in one direction is often misaligned with a line drawn by the head moving in the opposite direction.

Usually, in the case of inkjet recording apparatuses, a user manually outputs a test chart for correcting the misalignment of ruled lines and selects and enters an optimum value, thereby correcting the ejection timing based on the entered value. However, a wrong interpretation of the test result and an input error by a user unfamiliar with the apparatus might result in a greater misalignment.

With regard to liquid ejection type image forming apparatuses, Japanese Patent Laid-Open Publication No. 4-39041 (Patent Document 1) discloses an image forming apparatus that corrects density irregularities. This apparatus prints a test pattern on a recording medium or a transport belt, reads the color data of the test pattern, and changes the head driving conditions based on the read data, thereby correcting density irregularities.

Japanese Patent Registration NO. 3838251 (Patent Document 2) discloses an inkjet recording apparatus that detects a nozzle of a liquid ejection head having an ejection failure. The inkjet recording apparatus forms a test pattern of mixed color dots on a support/transport member using a cyan ink, a magenta ink and a yellow ink, reads the mixed color dots by using an RGB sensor, and detects a failing nozzle based on the read result.

Japanese Patent Laid-Open Publication No. 2005-342899 (Patent Document 3) discloses an inkjet recording apparatus that records either one or a combination of a failed nozzle detection pattern for detecting a failed nozzle and a color misregistration detection pattern for detecting an ink color misregistration on a part of a transport belt, detects the test pattern using an imaging unit such as a CCD, and performs correction based on the read result.

Meanwhile, with regard to electrophotographic image forming apparatuses using toner, Japanese Patent Laid-Open Publication No. 5-249787 (Patent Document 4) discloses an image forming apparatus that detects the density of a toner image using a light emitting device and a light receiving device. The light emitting device includes a light receiving element for receiving specular reflection light and a light receiving element for receiving scattered reflection light. The image forming apparatus forms toner images of different characteristics on a photoreceptive drum and detects the respective toner images.

Japanese Patent Laid-Open Publication No. 2006-178396 (Patent Document 5) discloses an image forming apparatus that detects the amount of attached toner based on a detection result of a sensor which is capable of detecting specular reflection light and diffused reflection light at the same time.

In the case of forming a test pattern on a transport belt and detecting the color of the test pattern or reading the test pattern as in Patent Documents 1-3, some combination of the color of the transport belt and the color of the ink has a small difference in color, which makes it difficult to accurately read the test pattern. In this case, for accurate color detection, it is necessary to use an expensive detecting unit including, e.g., a light source that emits lights of different colors and wavelengths. For example, in the case where an electrostatic transport belt is used that includes an insulation layer forming the front surface and an intermediate resistance layer forming the back surface and containing carbon for providing conductivity, because the external color of the electrostatic belt is black, it is difficult to detect black ink when detecting a test pattern based only on reflectance or the image read by an imaging unit, thereby failing to provide accurate detection.

More specifically, with regard to the image forming apparatus of Patent Document 1 that corrects density irregularities, because a sensor for detecting colors is used, the detection accuracy is reduced when detecting an ejected ink droplet having a color close to the color of the support/transport member. The sensor needs to have filters one for each color. An increased number of filters and sensors result in a higher cost. With regard to the inkjet recording apparatus of Patent Document 2 that detects a nozzle failure, because an RGB sensor is used, the detection accuracy is reduced when detecting an ejected ink droplet having a color close to the color of the support/transport member. Increasing the detection accuracy limits the number of combinations of the inks to be used and the transport member. If a laser beam is used which scans a very small point, small bits of foreign matter and scratches of the transport member easily affect the detection result, resulting in reduced detection accuracy. The RGB sensor needs to have sensors one for each color, which means an increased cost. With regard to the inkjet recording apparatus of Patent Document 3 using an imaging unit, as in the case of the inkjet recording apparatus of Patent Document 2, the detection accuracy is reduced when detecting an ejected ink droplet having a color close to the color of the support/transport member. Moreover, because an image is processed as a two-dimensional image, a processing system is required which has higher performance than a processing system that processes one-dimensional images. This results in an increase of the cost.

To avoid these problems, a system of detecting the amount of attached toner as used in the electrophotographic image forming apparatuses of Patent Documents 4 and 5 may be used. However, because toner particles maintain their shapes even when in contact with one another, it is possible to detect toner particles densely accumulated in the shape of a rectangular line. If this system is used in a liquid ejection type image forming apparatus, detected droplets only have a small level difference from noise, which prevents highly accurate detection of a test pattern.

In the case where an optical sensor reads a test pattern formed on plain paper as a recording medium into which ink can penetrate, the test pattern blurs due to penetration of ink, which prevents accurate detection of the impact positions of ink droplets.

BRIEF SUMMARY

In an aspect of this disclosure, there is provided an approach to accurately detect an adjustment pattern, which is formed of liquid droplets, for impact position displacement correction, and to accurately perform impact position detection and impact position displacement correction.

In another aspect of this disclosure, there is provided an image forming apparatus that is provided with a carriage in which recording heads having nozzles for ejecting liquid droplets are mounted and is configured to form an image on a recording medium being transported. The image forming apparatus includes a pattern forming unit that forms an impact position displacement adjustment pattern formed of plural independent liquid droplets on a water repellent member; a reading unit that includes a light emitting unit for emitting light onto the adjustment pattern and a light receiving unit for receiving specular reflection light from the adjustment pattern; and an impact position correcting unit that corrects an impact position of a liquid droplet to be ejected from the recording head based on a read result by the reading unit; wherein the reading unit is disposed on the carriage and is arranged close to a guide member that guides movement of the carriage.

In another aspect of this disclosure, there is provided a method of correcting a displacement of an impact position of a liquid droplet to be ejected from a recording head mounted in a carriage. The method comprises a pattern forming step of forming an impact position displacement adjustment pattern formed of plural independent liquid droplets on a water repellent member; a reading step of emitting light from a light emitting unit of a reading unit onto the adjustment pattern and receiving specular reflection light from the adjustment pattern by a light receiving unit of the reading unit, the reading unit being disposed on the carriage and being arranged close to a guide member that guides movement of the carriage; and an impact position correcting step of correcting an impact position of the liquid droplet to be ejected from the recording head based on a read result.

According to the aforementioned image forming apparatus and impact position correcting method, it is possible to accurately detect the impact position of a liquid droplet with a simple configuration and accurately correct displacement of the impact position of a liquid droplet to be ejected. Furthermore, because the reading unit is disposed on the carriage and is arranged close to a guide member that guides movement of the carriage, it is possible to reduce an adverse effect due to a displacement of the moving carriage, resulting in increased detection accuracy.

DETAILED DESCRIPTION OF THE PREFERRED EMBODIMENT

Figure 1:
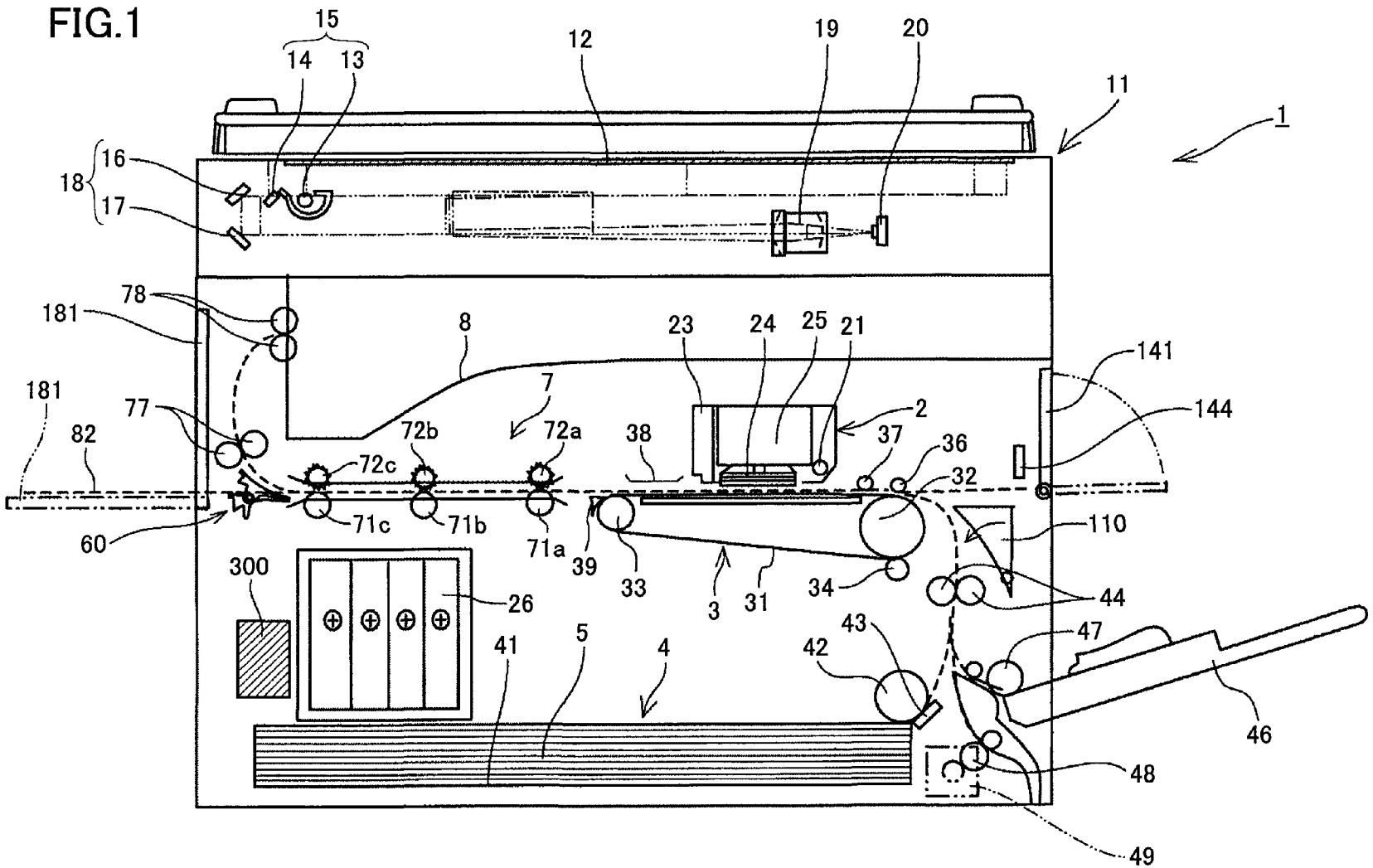
FIG. 1 is a schematic diagram illustrating a configuration of an image forming apparatus according to an embodiment of the present invention.
Figure 2:
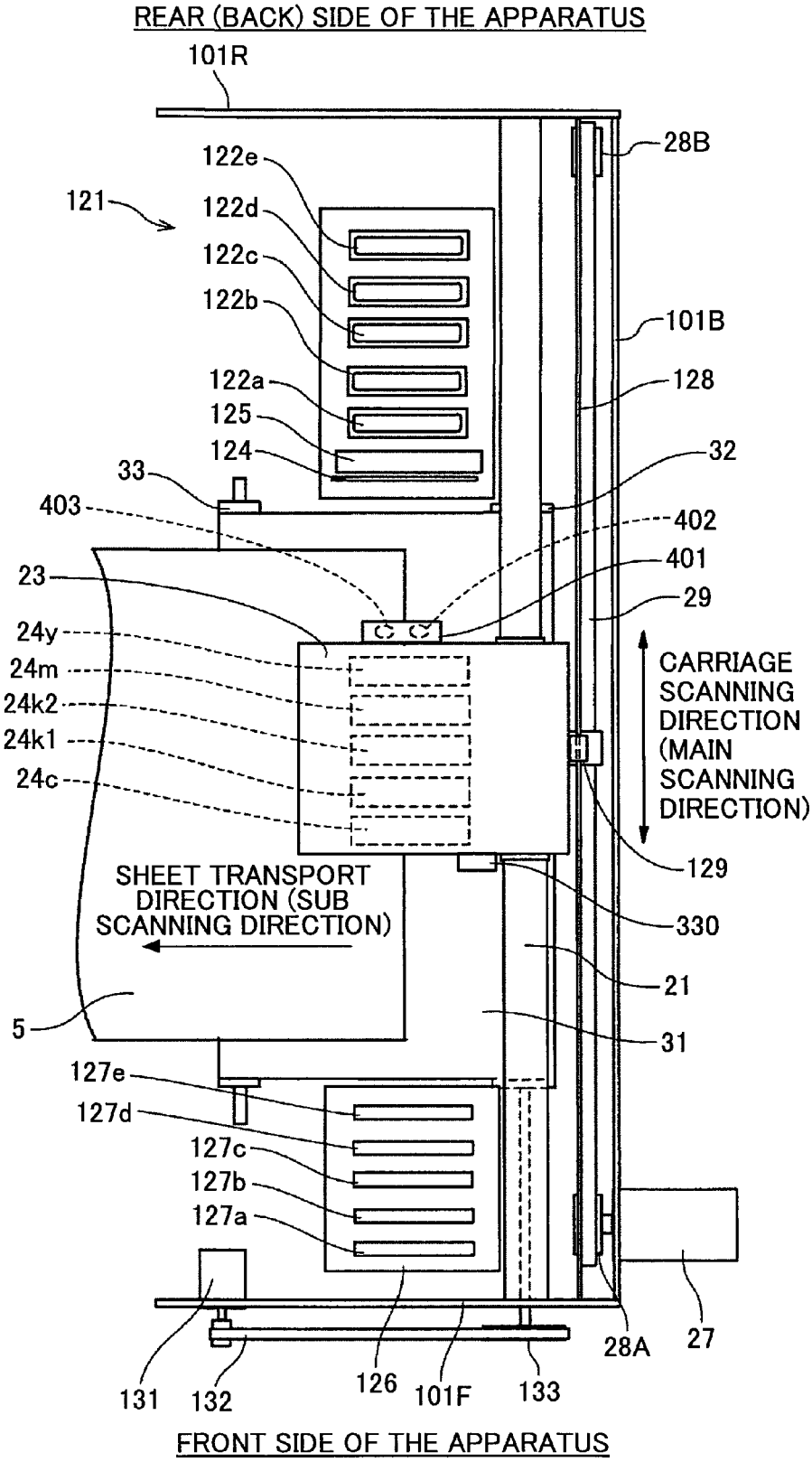
FIG. 2 is a plan view illustrating an image forming unit and a sub scanning direction transport unit of the image forming apparatus of FIG. 1.
Figure 3:
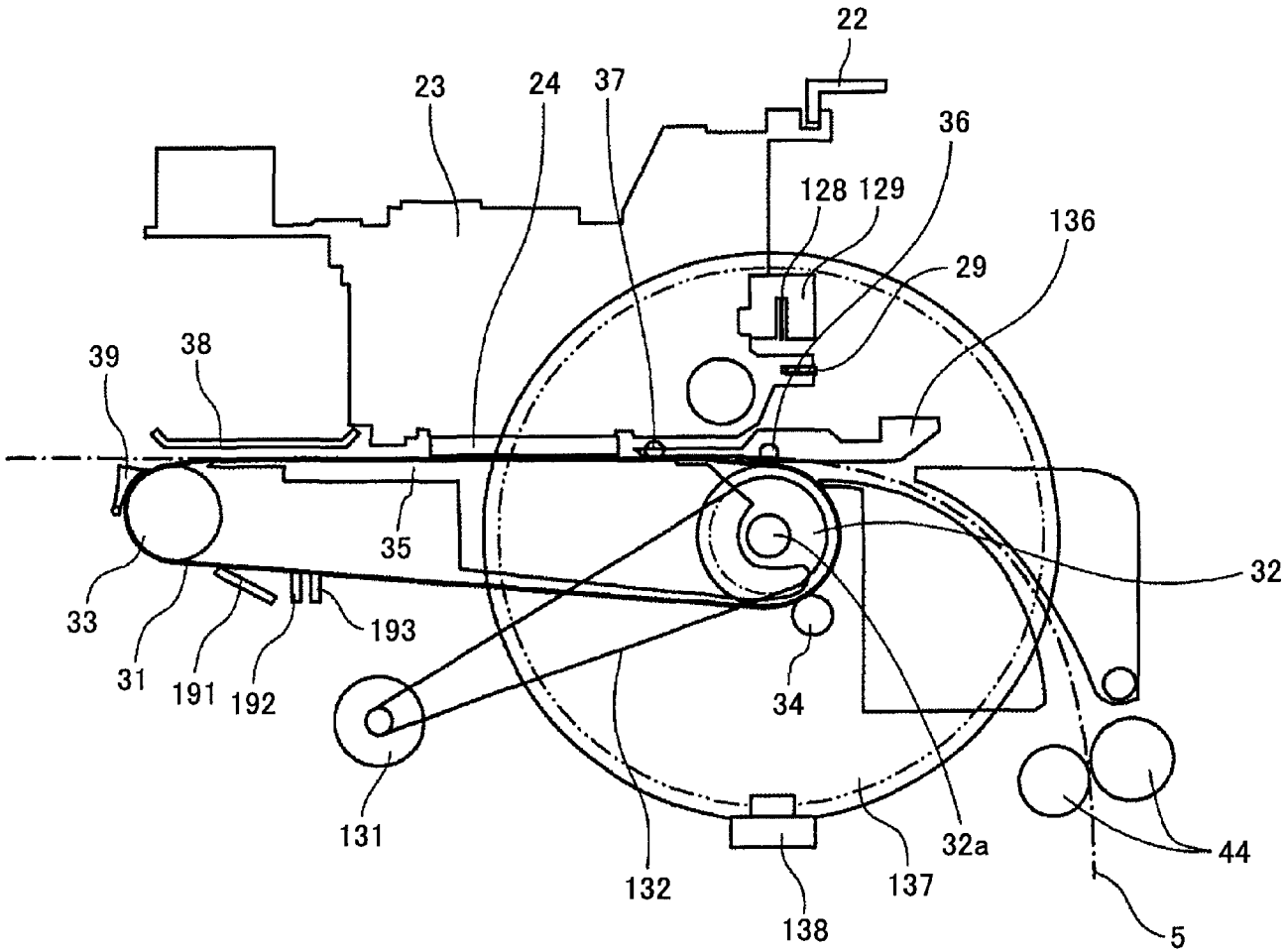
FIG. 3 is a cut-away front view illustrating the image forming apparatus of FIG. 1.

Preferred embodiments of the present invention are described hereinafter with reference to the accompanying drawings. An image forming apparatus of an embodiment of the present invention is described below with reference to FIGS. 1 through 3. FIG. 1 schematically illustrates a configuration of the image forming apparatus. FIG. 2 is a plan view illustrating an image forming unit 2 and a sub scanning direction transport unit 3 of the image forming apparatus. FIG. 3 is a side view illustrating the image forming apparatus.

The image forming apparatus includes, in an apparatus main body 1, the image forming unit 2 that forms an image on a sheet (recording medium) 5 and the sub scanning direction transport unit 3 that transports the sheet 5. In the image forming apparatus, sheets 5 are fed one by one from a sheet feed unit 4 including a sheet feed cassette 41 disposed at the bottom of the apparatus main body 1. The sheet 5 is transported by the sub scanning direction transport unit 3 to the position facing the image forming unit 2, at which an image is formed (recorded) on the sheet 5 by liquid droplets ejected from the image forming unit 2. Then the sheet 5 is ejected by a sheet ejection/transport unit 7 onto a sheet ejection tray 8 disposed at the upper side of the apparatus main body 1.

The image forming apparatus further includes an image reading unit (scanner unit) 11 disposed above the sheet ejection tray 8 in the apparatus main body 1 and configured to read images. The image reading unit 11 serves as an image data (print data) input unit for reading image data, based on which an image is formed by the image forming unit 2. In the image reading unit 11, an image of the original document placed on a contact glass 12 is scanned by moving a first scanning optical unit 15, including a light source 13 and a mirror 14, and a second scanning optical unit 18, including mirrors 16 and 17. The scanned image of the original document is read as image signals by an image reading element 20 disposed behind a lens 19. The read image signals are digitized and processed into print data to be printed out.

With reference to FIG. 2, in the image forming unit 2 of the image forming apparatus, a carriage 23 is movable in the main scanning direction and is held at one side by a carriage guide (guide rod) 21 and a guide rail (not shown). The carriage 23 is moved in the main scanning direction by a main scanning motor 27 via a timing belt 29 extending around a drive pulley 28A and a driven pulley 28B.

More specifically, with reference to FIG. 2, in the image forming unit 2 of the image forming apparatus, the carriage 23 is movable in the main scanning direction and is held by the carriage guide (guide rod) 21 as the main guide member, extending between a front side panel 101F and a rear side panel 101R, and a guide stay (not shown) as a sub guide member, disposed at the side of a rear stay 101B.

On the carriage 23 are mounted a total of five recording heads (liquid ejection heads) 24, namely, recording heads 24*k*1 and 24*k*2 for ejecting black (K) ink, a recording head 24*c* for cyan (C) ink, a recording head 24*m* for magenta (M) ink, and a recording head 24*y* for yellow (Y) ink. These recording heads 24*k*1, 24K2, 24*c*, 24*m*, and 24*y* may be referred to as the recording heads 24 when the colors thereof are not referred to. The image forming unit 2 is a shuttle type, which reciprocally moves the carriage 23 in the main scanning direction while ejecting liquid droplets from the recording heads 24 to form an image on the sheet 5 being transported in a sheet transport direction (the sub scanning direction) by the sub scanning direction transport unit 3.

On the carriage 23 are also mounted sub tanks 25 (FIG. 1) that supply color recording liquids to the corresponding recording heads 24. Referring back to FIG. 1, ink cartridges 26 respectively storing black (K) ink, cyan (C) ink, magenta (M) ink, and yellow (Y) ink are detachably attached to a cartridge attachment section 26A from the front side of the apparatus main body 1. The inks (recording liquids) in the ink cartridges 26 are supplied to the corresponding sub tanks 25. The black ink is supplied from the black ink cartridge 26 to the two black sub tanks 25.

The recording head 24 may be a piezo type that includes a pressure generating unit (actuator unit), which is used for applying pressure to ink in an ink passage (pressure generating chamber) and is configured to deform a wall of the ink passage so as to change the volume of the ink passage, thereby ejecting ink droplets; a thermal type configured to heat the ink in an ink passage using a heating element so as to form bubbles, thereby ejecting the ink with pressure of the bubbles; or a an electrostatic type that includes a diaphragm on a wall of an ink passage and an electrode opposing the diaphragm, and is configured to deform the diaphragm with static electricity between the diaphragm and the electrode so as to change the volume of the ink passage, thereby ejecting ink droplets.

A linear scale 128 is disposed that extends between the front side panel 101F and the rear side panel 101R in the main scanning direction of the carriage 23. The carriage 23 is provided with an encoder sensor 129 including a transmissive photo sensor for detecting slits of the linear scale 128. The linear scale 128 and the encoder sensor 129 constitute a linear encoder that detects movement of the carriage 23.

On one side of the carriage 23 is disposed a pattern reading sensor 401 as a reading unit (detecting unit) which includes reflective photo sensor having a light emitting unit and a light receiving unit and is configured to read an adjustment pattern for detecting impact position displacement. The pattern reading sensor 401 reads an adjustment pattern for impact position displacement detection formed on a water repellent sheet as described below. On the other side of the carriage 23 is disposed a sheet detection sensor (leading edge detection sensor) 330 as a sheet detecting unit which includes a reflective photo sensor for detecting the leading edge of a member being transported (target member).

A maintenance recovery mechanism (device) 121 for maintaining and restoring the condition of nozzles of the recording head 24 is provided in a non-printing region at one side in the scanning direction of the carriage 23. The maintenance recovery mechanism 121 includes one suction cap 122*a*, serving also as a dry-proof cap, and four dry-proof caps 122*b* through 122*e* for capping nozzle faces of the five recording heads 24. The maintenance recovery mechanism 121 further includes a wiper blade 124 for wiping the nozzle faces 24*a* of the recording heads 24, and an idle ejection receiver 125 for idle ejection. Another idle ejection receiver 126 for idle ejection is disposed in a non-printing region at the other end in the scanning direction of the carriage 23. The idle ejection receiver 126 includes openings 127*a* through 127*e*.

Referring also to FIG. 3, the sub scanning direction transport unit 3 includes a transport roller 32 as a drive roller that changes a transport direction of the sheet 5 fed from the lower side by 90 degrees such that the sheet 5 is transported in a manner facing the image forming unit 2, a driven roller 33 as a tension roller, an endless transport belt 31 extending around the transport roller 32 and the driven roller 33, a charging roller 34 as a charger that charges the surface of the transport belt 31 with a high voltage (alternating current) from a high-voltage power supply, a guide member 35 that guides the transport belt 31 within an area opposing the image forming unit 2, pressure rollers 36 and 37 rotatably supported by a support member 136 and configured to press the sheet 5 against the transport belt 31 at a position opposing the transport roller 32, a guide plate 38 that presses the upper surface of the sheet 5 on which images are formed by the image forming unit 2, and a separation claw 39 that separates the sheet 5 on which images are formed from the transport belt 31.

Figure 4:
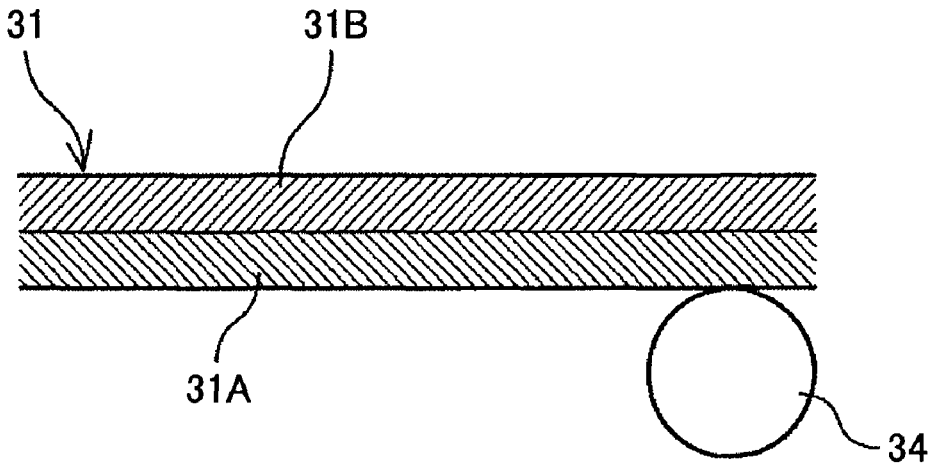
FIG. 4 is a schematic cut-away side view illustrating an example of a transport belt.

The transport belt 31 is rotated to transport the sheet 5 in the sheet transport direction (sub scanning direction) when the transport roller 32 is rotated through a timing belt 132 and a timing roller 133 by a sub scanning motor 131 using a DC brushless motor. Referring to FIG. 4, the transport belt 31 has a double layer structure including a front layer (sheet attracting layer) 31A and a back layer (intermediate resistance layer, grounding layer) 31B. The front layer 31A may be made of a pure resin material, e.g., an ETFE pure material, not subjected to resistance control. The back layer 31B may be made of the same material as the front layer but is subjected to resistance control using carbon. The transport belt 31 may not have a double layer structure as described above, and may have a single layer structure or a multiple layer structure having three or more layers.

Disposed between the driven roller 33 and the charging roller 34 are a cleaning unit (paper powder removing unit) 191 made of a PET film of Mylar (trademark) that is in contact with the transport belt 31 to remove paper powder adhering to the transport belt 31, a cleaning brush 192 that is in contact with the transport belt 31, and a discharging brush 193 that discharges the surface of the transport belt 31.

A code wheel 137 of high resolution is attached to a shaft 32*a* of the transport roller 32. An encoder sensor 138 including a transmissive photo sensor for detecting slits (not shown) formed in the code wheel 137. The code wheel 137 and the encoder sensor 138 form a rotary encoder.

The sheet feed unit 4 includes the sheet cassette 41 that is removable from the apparatus main body 1 and capable of stacking and storing a large number of sheets 5 therein, a sheet feed roller 42 and a friction pad 43 for feeding the sheets 5 one by one, and a pair of registration rollers 44 for registration of the transported sheet 5.

The sheet feed unit 4 includes a manual sheet feed tray 46 capable of stacking and storing a large number of sheets 5 therein, a manual sheet feed roller 47 that feeds the sheets 5 one by one from the manual sheet feed tray 46, a vertical transport roller 48 that transports the sheets 5 fed from another sheet feed cassette (not shown), which can be optionally attached to the lower side of the apparatus main body 1 and from a duplex print unit (not shown). Rollers for feeding the sheet 5 to the sub scanning direction transport unit 3, such as the sheet feed roller 42, the pair of registration rollers 44, the manual sheet feed roller 47, and the vertical transport roller 48, are driven by a sheet feed motor 49, which is an HB stepping motor, via an electromagnetic clutch (not shown).

The sheet ejection/transport unit 7 includes three transport rollers 71*a*, 71*b*, and 71*c* (also referred to as transport rollers 71) that transport the sheet 5 separated by the separation claw 39 of the sub scanning direction transport unit 3; three spurs 72*a*, 72*b*, and 72*c* (also referred to as spurs 72) facing transport rollers 71*a*, 71*b*, and 71*c*, respectively; a pair of reverse rollers 77 for reversing the sheet 5; and a pair of reverse/ejection rollers 78 for outputting the sheet 5 with its face down onto the sheet ejection tray 8.

As shown in FIG. 1, in the image forming apparatus, a single sheet manual feed tray 141 for manually feeding a single sheet is rotatably attached to one side of the apparatus main body 1. When manually feeding a single sheet, the single sheet manual feed tray 141 is rotated to an open position indicated by a double-dot chain line. The sheet 5 that has been manually fed from the single sheet manual feed tray 141 is guided by the upper surface of a guide plate 110 to be inserted straight between the transport roller 32 and the pressure roller 36 of the sub scanning direction transport unit 3.

A straight ejection tray 181 to which a sheet 5 having an image formed thereon is ejected with its face up is rotatably attached to the other side of the apparatus main body 1. When the straight ejection tray 181 is rotated to an open position indicated by a double-dot chain line, the sheet 5 transported by the sheet ejection/transport unit 7 can be output straight to the straight ejection tray 181.

Figure 5:
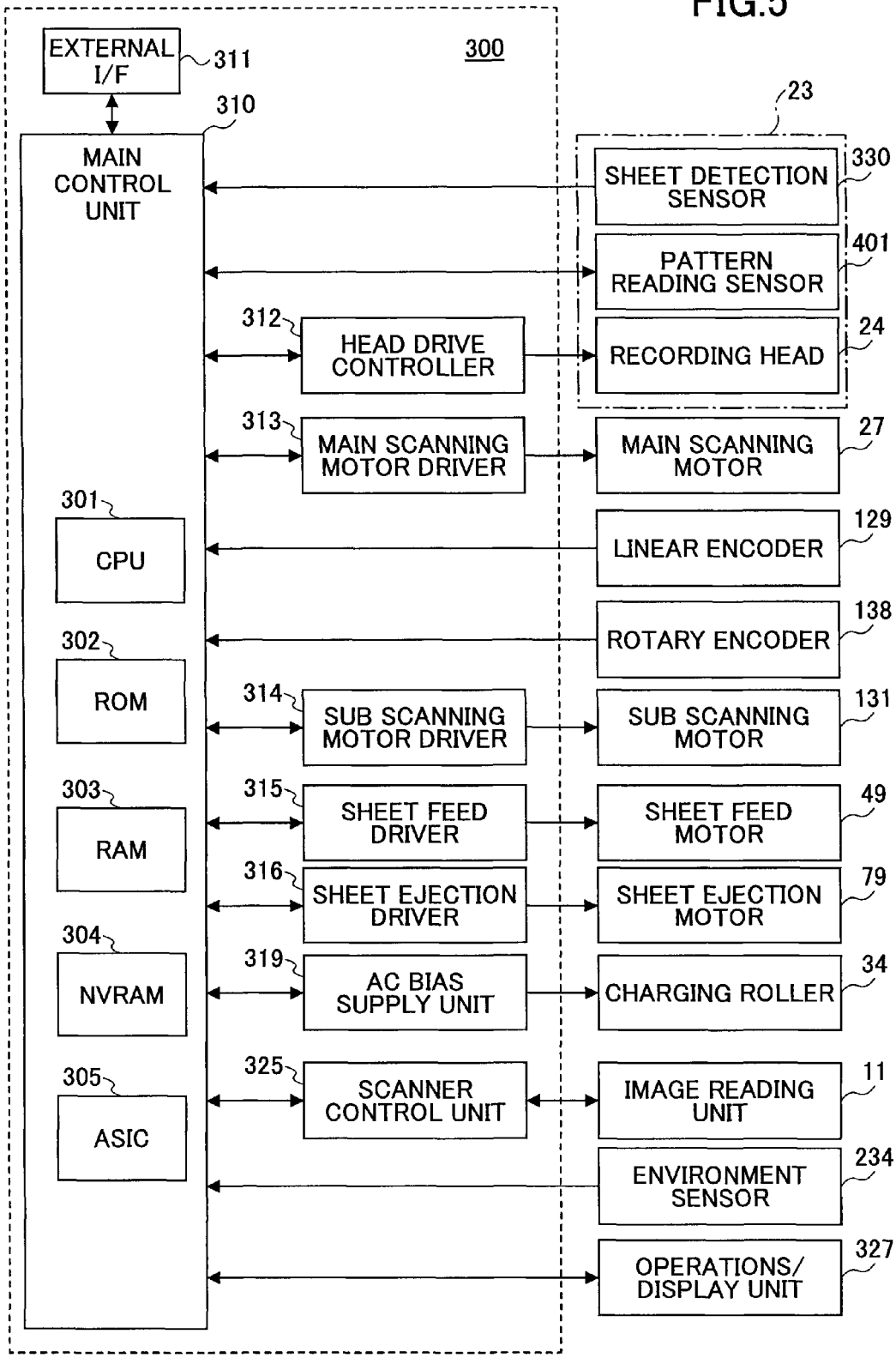
FIG. 5 is a block diagram illustrating a control unit of the image forming apparatus of FIG. 1.

The following describes an overview of a control unit 300 of the image forming apparatus with reference to FIG. 5.

The control unit 300 includes a main control unit 310 that controls the entire operation of the image forming apparatus and controls formation of an adjustment pattern, detection of an adjustment pattern, and adjustment (correction) of an impact position. The main control unit 310 includes a CPU 301, a ROM 302 that stores programs to be executed by the CPU 301 and other fixed data, a RAM 303 that temporarily stores image data, etc., a nonvolatile memory (NVRAM) 304 that retains data even when power is removed, and an ASIC 305 that processes input/output signals for processing images such as sorting and for controlling the apparatus.

The control unit 300 further includes an external I/F 311 through which signals and data are transmitted to a host device from the main control unit 310 and to the host device from the main control unit 310; a head drive controller 312 including a head driver (actually attached to the side of the recording heads 24) that controls and drives the recording heads 24 and includes an ASIC for head data generation sequence conversion; a main scanning motor driver 313 that drives the main scanning motor 27 for moving the carriage 23; a sub scanning motor driver 314 that drives the sub scanning motor 131; a sheet feed driver 315 that drives the sheet feed motor 49; a sub scanning motor driver 314 that drives the subs scanning motor 131; a sheet feed driver 315 that drives the sheet feed motor 49; a sheet ejection driver 316 that drives a sheet ejection motor 79 for driving the rollers of the sheet ejection/transport unit 7; an AC bias supply unit 319 that supplies an AC bias to the charging roller 34; a maintenance recovery system driver (not shown) that drives a maintenance recovery motor (not shown) for driving the maintenance recovery mechanism 121; a duplexing unit driver (not shown) that drives a duplexing unit when the duplexing unit is attached; a solenoid driver (not shown) that drives various solenoids (SOLs); a clutch driver (not shown) that drives electromagnetic clutches (not shown); and a scanner control unit 325 that controls the image reading unit 11.

The main control unit 310 receives various detection signals, such as signals indicating the temperature and humidity (environmental conditions) around the transport belt 31 from an environment sensor 234. The main control unit 310 receives detection signals from various other sensors (not shown). The main control unit 310 receives instructions entered through various keys, such as numeric keys and a print start key, disposed on the apparatus main body 1. The main control unit 310 also receives instructions entered through an operations/display unit 327 and outputs information to be displayed to the operations/display unit 327.

The main control unit 310 also receives an output signal from the photo sensor (encoder sensor) 129 of the linear encoder for detecting the position of the carriage 23, and controls the main scanning motor 27 through the main scanning motor driver 313 according to the output signal so as to reciprocate the carriage 23 in the main scanning direction. The main control unit 310 also receives an output signal (pulse) from the photo sensor (encoder sensor) 138 of the rotary encoder for detecting the amount of the rotation of the transport belt 31, and controls the sub scanning motor 131 through the sub scanning motor driver 314 according to the output signal so as to rotate the transport belt 31 via the transport roller 32.

The main control unit 310 controls operations of moving a water repellent sheet to a position at which an adjustment pattern is to be formed according to a detection signal from the sheet detection sensor 330, forming an adjustment pattern on the water repellent sheet, and causing a light emitting unit of the pattern reading sensor 401 mounted on the carriage 23 to emit a light onto the adjustment pattern, detecting a displacement of the impact position by detecting the adjustment pattern based on a received output signal from a light receiving unit, and correcting a liquid ejection timing of the recording heads 24 to eliminate the displacement of the impact position based on the result. The control operations by the main control unit 310 are described below in greater detail.

An image forming operation by the image forming apparatus having the above-described configuration is briefly described below. The amount of rotation of the transport roller 32, which drives the transport belt 31, is detected. According to the detected amount of rotation, the sub scanning motor 131 is controlled. The AC bias supply unit 319 applies a bipolar rectangular-wave high voltage as an alternating voltage to the charging roller 34. Thus, the transport belt 31 is alternately positively and negatively charged at predetermined widths in the transport direction of the transport belt 31, thereby forming a non-uniform electric field on the transport belt 31.

When the sheet 5 sent from the sheet feed unit 4 passes through between the transport roller 32 and the first pressure roller 36 onto the transport belt 31 on which the non-uniform electric field is generated by positive and negative charges, the sheet 5 is instantaneously polarized along a direction of the electric field and is adhered onto the transport belt 31 due to an electrostatic attraction force. Thus, the sheet 5 is transported along with the movement of the transport belt 31.

The sheet 5 is intermittently transported by the transport belt 31. The carriage 23 is moved in the main scanning direction so as to record (print) images on the non-moving sheet 5 by ejecting droplets of recording liquids from the recording heads 24. The separation claw 39 separates the leading edge of the printed sheet 5 from the transport belt 31 to transport the sheet 5 to the sheet ejection/transport unit 7, by which the sheet 5 is ejected to the sheet ejection tray 8.

The carriage 23 is moved to the side of the maintenance recovery mechanism 121 while standing by for a print (recording) operation. The nozzle faces of the recording heads 24 are capped by the caps 122 for keeping the nozzles wet, thereby preventing poor ejection due to ink dryout. A recovery operation is performed for ejecting thickened recording liquid and bubbles by suctioning the recording liquid from the nozzles of the recording heads 24 capped by the suction cap 122*a* and the dry-proof caps 122*b*-122*e*. The wiper blade 124 wipes the nozzle faces of the recording heads 24 to remove the ink adhering to the nozzle faces. Further, before starting a recording operation or during a recording operation, idle ejection is performed for ejecting ink to the idle ejection receiver 125 and not for forming images. The idle ejection enables the recording heads 24 to maintain stable ejection performance.

Figure 6:
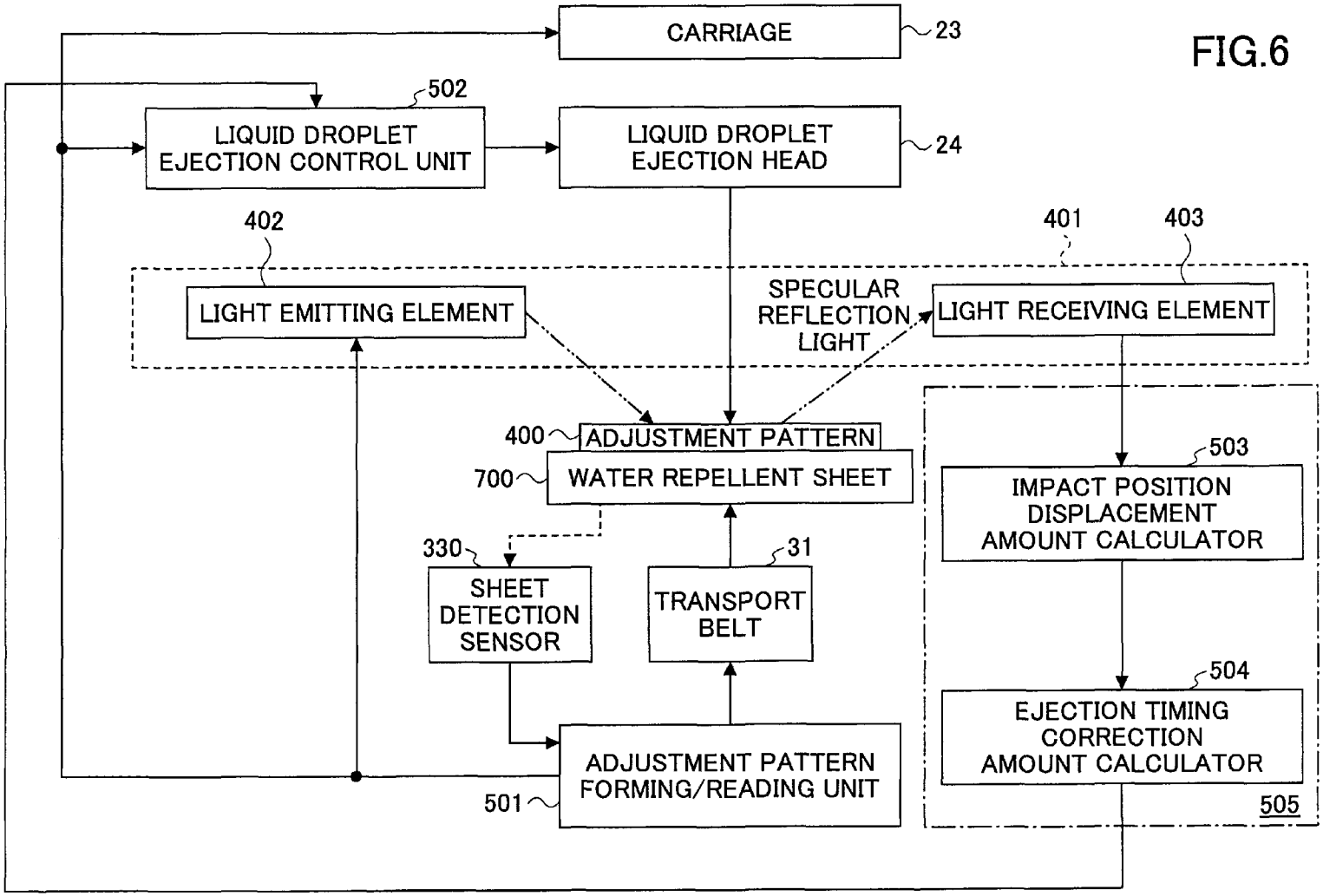
FIG. 6 is a functional block diagram illustrating components associated with liquid droplet impact position detection and liquid droplet impact position correction.
Figure 7:
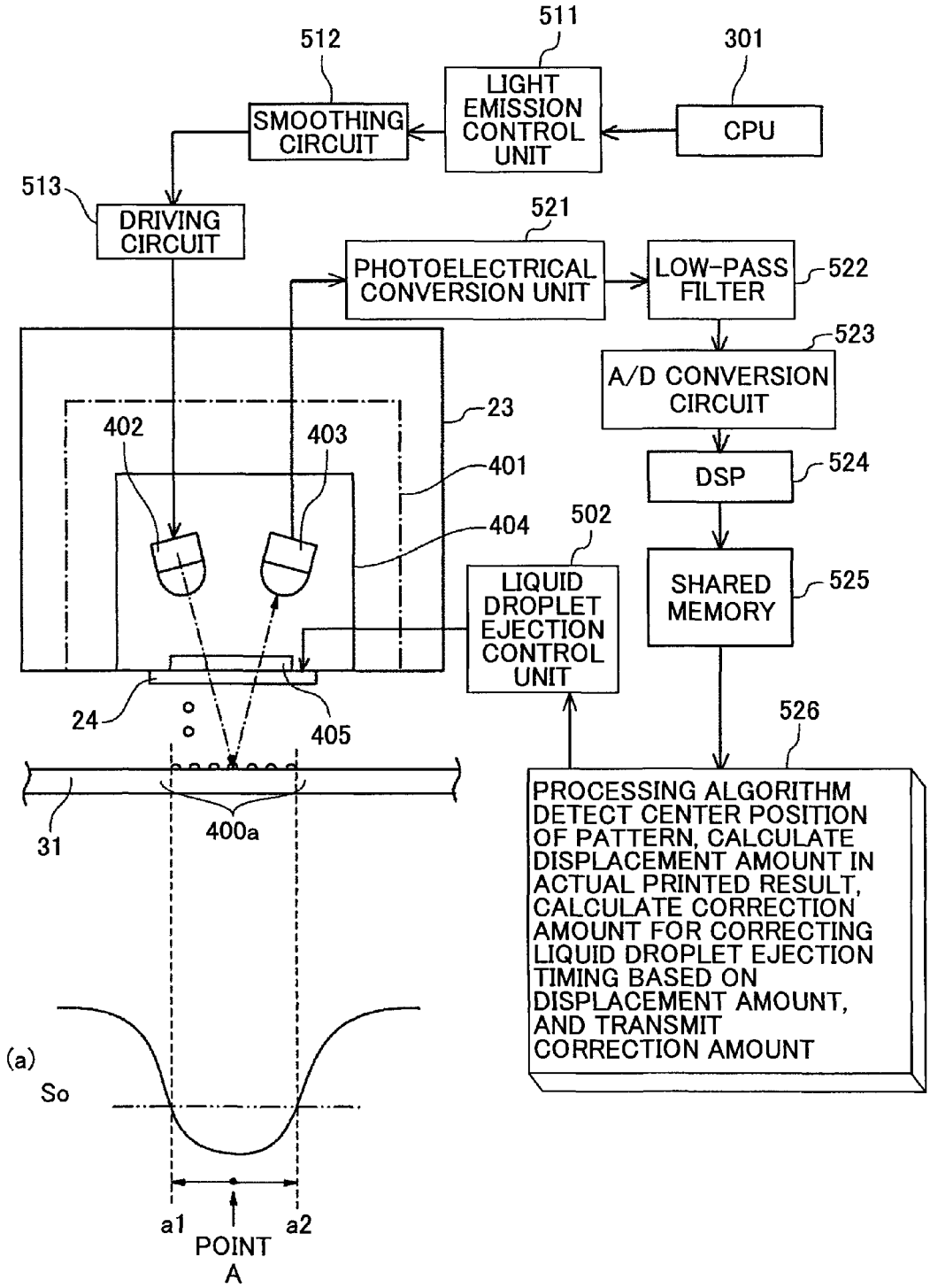
FIG. 7 is a functional block diagram illustrating a specific example of components associated with droplet impact position detection and droplet impact position correction according to the first embodiment of the present invention.

Components associated with a control operation for correcting the liquid droplet impact position are described below with reference to FIGS. 6 and 7. FIG. 6 is a functional block diagram illustrating a liquid droplet impact position displacement correcting unit. FIG. 7 is a functional block diagram illustrating a flow of a liquid droplet impact position displacement correcting operation.

Figure 9:
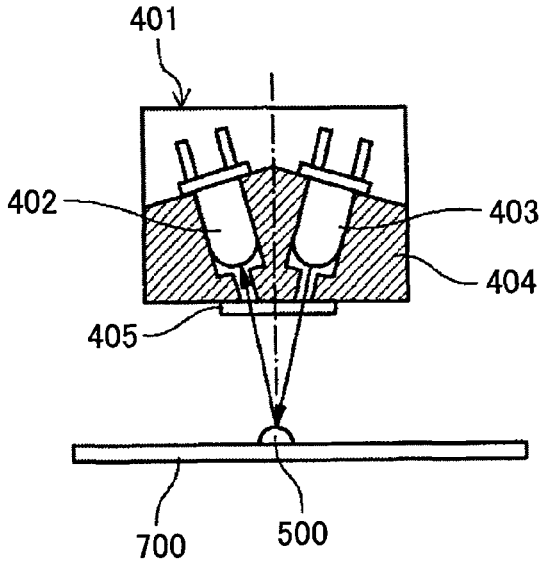
FIG. 9 is a schematic diagram illustrating a pattern reading sensor.

As shown in FIGS. 7 and 9, the carriage 23 is provided with the pattern reading sensor 401 that reads an adjustment pattern (which may be referred to as a DRESS pattern, a test pattern, a detection pattern, etc.,) formed on a water repellent sheet 700. The pattern reading sensor 401 has a package structure including a light emitting element 402 as a light emitting unit and a light receiving element 403 as a light receiving element, which are aligned in the direction orthogonal to the main scanning direction and are held by a holder 404. The light emitting element 402 is configured to emit light to the adjustment pattern 400 on the water repellent sheet 700. The light receiving element 403 receives specular reflection light from the adjustment pattern 400. A lens 405 is attached to a light emitting portion and a light incident portion of the holder 404.

As mentioned above, the light emitting element 402 and the light receiving element 403 in the pattern reading sensor 401 are aligned in the direction orthogonal to the main scanning direction of the carriage 23 as shown in FIG. 2. This configuration can reduce an adverse effect due to a variation of the moving speed of the carriage 23 on the detection result (read result). A relatively simple and inexpensive light source, such as an LED, that emits infrared rays or visible light may be used as the light emitting element 402. An inexpensive lens is used in place of using a high accuracy lens, and hence the spot diameter of the light source (detection area, detection region) is of the order of millimeters.

Figure 8:
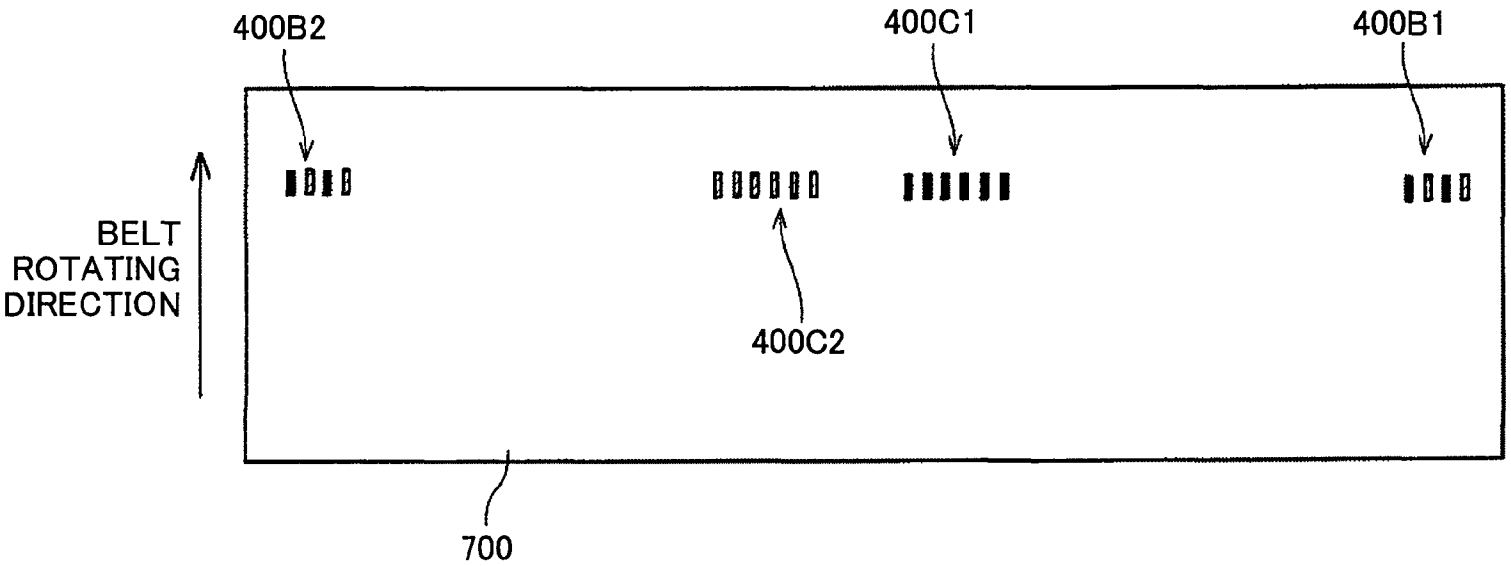
FIG. 8 is a diagram illustrating exemplary adjustment patterns formed on a water repellent sheet.

An adjustment pattern forming/reading control unit 501 is configured to, when the water repellent sheet 700 is transported by the transport belt 31 and the leading edge of the water repellent sheet 700 is detected by the sheet detection sensor 330, transport the water repellent sheet 700 to a position at which an adjustment pattern 400 is to be formed, and controls a liquid droplet ejection control unit 502 to cause the recording heads 24 as a liquid ejection unit to eject liquid droplets, thereby forming adjustment patterns 400 (400B1, 400B2, 400C1, 400C2, and so on) as shown in FIG. 8. Each adjustment pattern 400 includes lines formed of plural liquid droplets 500. The adjustment pattern forming/reading control unit 501 includes the CPU 301 of the main control unit 310.

The adjustment pattern forming/reading control unit 501 controls the pattern reading sensor 401 to read the adjustment pattern 400 formed on the water repellent sheet 700. This adjustment pattern read control is performed by causing the light emitting element 402 of the pattern reading sensor 401 to emit light while moving the carriage 23 in the main scanning direction. Specifically, referring to FIG. 7, the CPU 301 of the main control unit 310 sets a PWM value in a light emission control unit 511 for driving the light emitting element 402 of the pattern reading sensor 401. An output from the light emission control unit 511 is smoothed by a smoothing circuit 512 and supplied to a drive circuit 513. Thus the drive circuit 513 drives the light emitting element 402 to emit light onto the adjustment pattern 400 on the water repellent sheet 700.

When the light emitting element 402 emits light onto the adjustment pattern 400 on the water repellent sheet 700, specular reflection light from the adjustment pattern 400 is incident on the light receiving element 403. The light receiving element 403 outputs a detection signal according to the amount of received specular reflection light. The detection signal is input to an impact position displacement amount calculator 503. More specifically, with reference to FIG. 7, the output signal from the light receiving element 403 of the pattern reading sensor 401 is photoelectrically converted by a photoelectrical conversion circuit 521 (not shown in FIG. 5) of the main control unit 310. A low-pass filter circuit 522 removes noise from the photoelectrically converted signal (sensor output voltage). Then the signal is A/D converted by an A/D conversion circuit 523 and is loaded as sensor output voltage data into a shared memory 525.

The impact position displacement amount calculator 503 of the impact position correction unit 505 detects the position of the adjustment pattern 400 based on the output result of the light receiving element 403 of the pattern reading sensor 401, and calculates the amount of displacement (liquid droplet impact position displacement amount) from a reference position. The impact position displacement amount calculated by the impact position displacement amount calculator 503 is supplied to an ejection timing correction amount calculator 504. The ejection timing correction amount calculator 504 calculates a correction amount of the ejection timing to be used when the liquid droplet ejection control unit 502 drives the recording heads 24 so as to eliminate the impact position displacement. The calculated ejection timing correction amount is set to the liquid droplet ejection control unit 502. When driving the recording heads 24, the liquid droplet ejection control unit 502 uses an ejection timing which has been corrected based on the correction amount.

More specifically, as shown in FIG. 7, the CPU 301 performs a processing algorithm 526 to detect the center position (point A) of each of line-shaped patterns (in this example, 400*a* denotes a single line-shaped pattern) of the adjustment pattern based on a sensor output voltage So as shown in, e.g., FIG. 7-(*a*), calculates a displacement amount of the actual impact position of a liquid droplet ejected by the recording head 24 from the reference position (a reference head), calculates a correction amount of the print ejection timing based on the displacement amount, and sets the correction amount in the liquid droplet ejection control unit 502.

The adjustment pattern 400 is described below referring also to FIG. 10 and the following drawings.

The principle of the impact position detection (pattern detection) is described below according to an embodiment of the present invention. Diffusion of light from a liquid droplet (hereinafter referred to also as an ink droplet) upon emitting light onto the ink droplet is described below with reference to FIG. 10.

Figure 10:
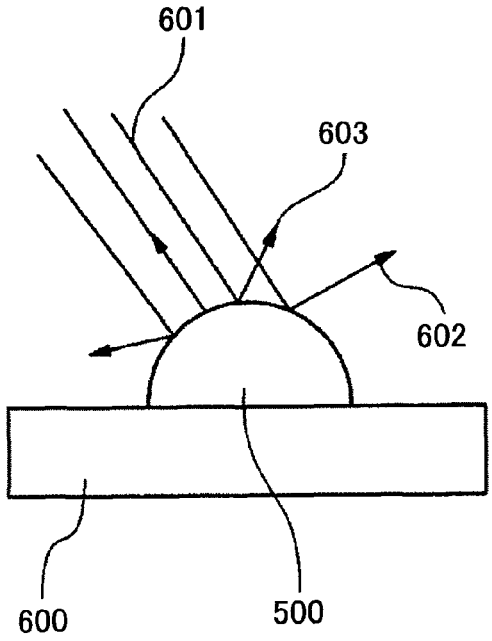
FIG. 10 is a diagram for explaining a principle of pattern detection, the diagram showing diffusion of light by a liquid droplet.
Figure 11:
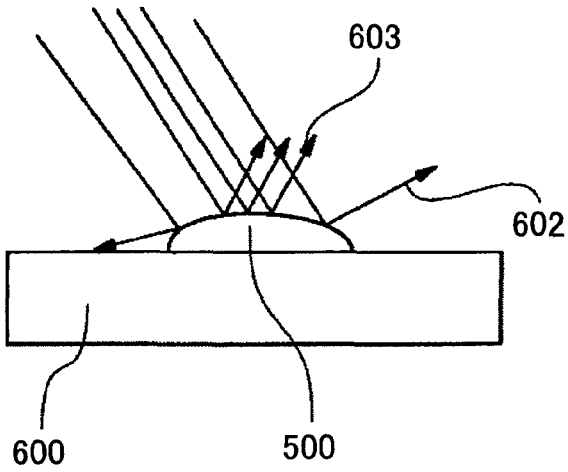
FIG. 11 is a diagram showing diffusion of light by a flat liquid droplet.
Figure 12:
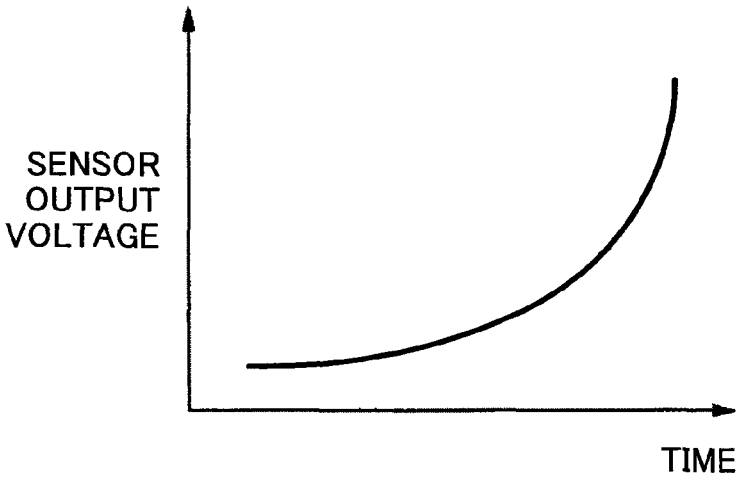
FIG. 12 is a graph showing a relationship between time since the impact of a liquid droplet and the sensor output voltage.

As shown in FIG. 10, when a light 601 is incident on an ink droplet ejected onto a target member 600 (the ink droplet is formed into a hemispherical shape upon impact with the target member 600), most of the incident light is detected as diffused reflection light 602 because the ink droplet 500 has a glossy round surface. The amount of light detected as specular reflection light 603 is small. However, as shown in FIG. 11, the ink droplet 500 is dried to lose the surface gloss over time, and gradually changes its shape from hemispherical to flat. As a result, the portion of the area of the portion from which the specular reflection light 603 are returned and the ratio of the specular reflection light 603 with respect to the diffused reflection light 602 are relatively increased. Accordingly, as shown in FIG. 12, the sensor output voltage based on the signal output from the light receiving element 403, which is configured to receive the specular reflection light 603, is gradually reduced with time, and accordingly the detection accuracy is reduced with time.

Detection of the position of an ink droplet 500 forming the adjustment pattern 400 (more specifically, a single line-shaped pattern 400*a*) is described with reference to FIG. 13.

The surface of the water repellent sheet 700 has a glossy surface and easily returns the light incident from the light emitting element 402 as specular reflection light. Therefore, in FIG. 13-(*b*), most of the incident light 601 from the light emitting element 402 is specularly reflected by the surface of the water repellent sheet 700, so that the amount of the specular reflection light 603 is increased. Accordingly, as shown in FIG. 13-(*a*), the sensor output voltage based on the output of the light receiving element 403, which is configured to receive the specular reflection light 603, becomes relatively high.

Figure 13:
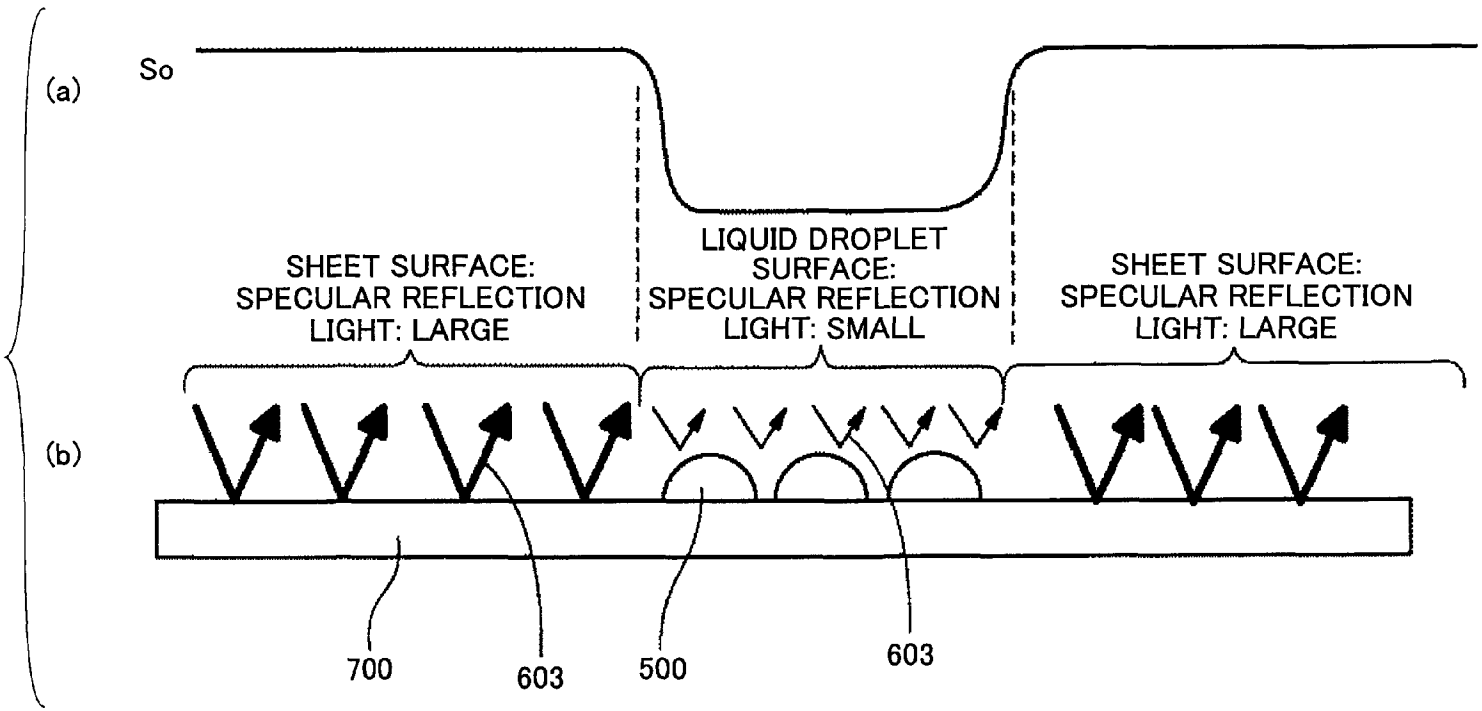
FIG. 13 is a schematic diagram for explaining an adjustment pattern according to an embodiment of the present invention.

On the other hand, in FIG. 13-(*b*), in a region where ink droplets are independently and densely disposed, the light is diffused by the glossy hemispherical surfaces of the ink droplets 500, resulting in a small amount of specular reflection light 603. Accordingly, as shown in FIG. 13-(*a*), the sensor output voltage based on the output of the light receiving element 403, which is configured to receive the specular reflection light 603, becomes relatively low. The ink droplets 500 are regarded as being densely disposed when, in a predetermined detection region, the area of the space between the ink droplets 500 is smaller than the area of the portions where the ink droplets 500 are disposed (ink droplet attached area).

Figure 14:
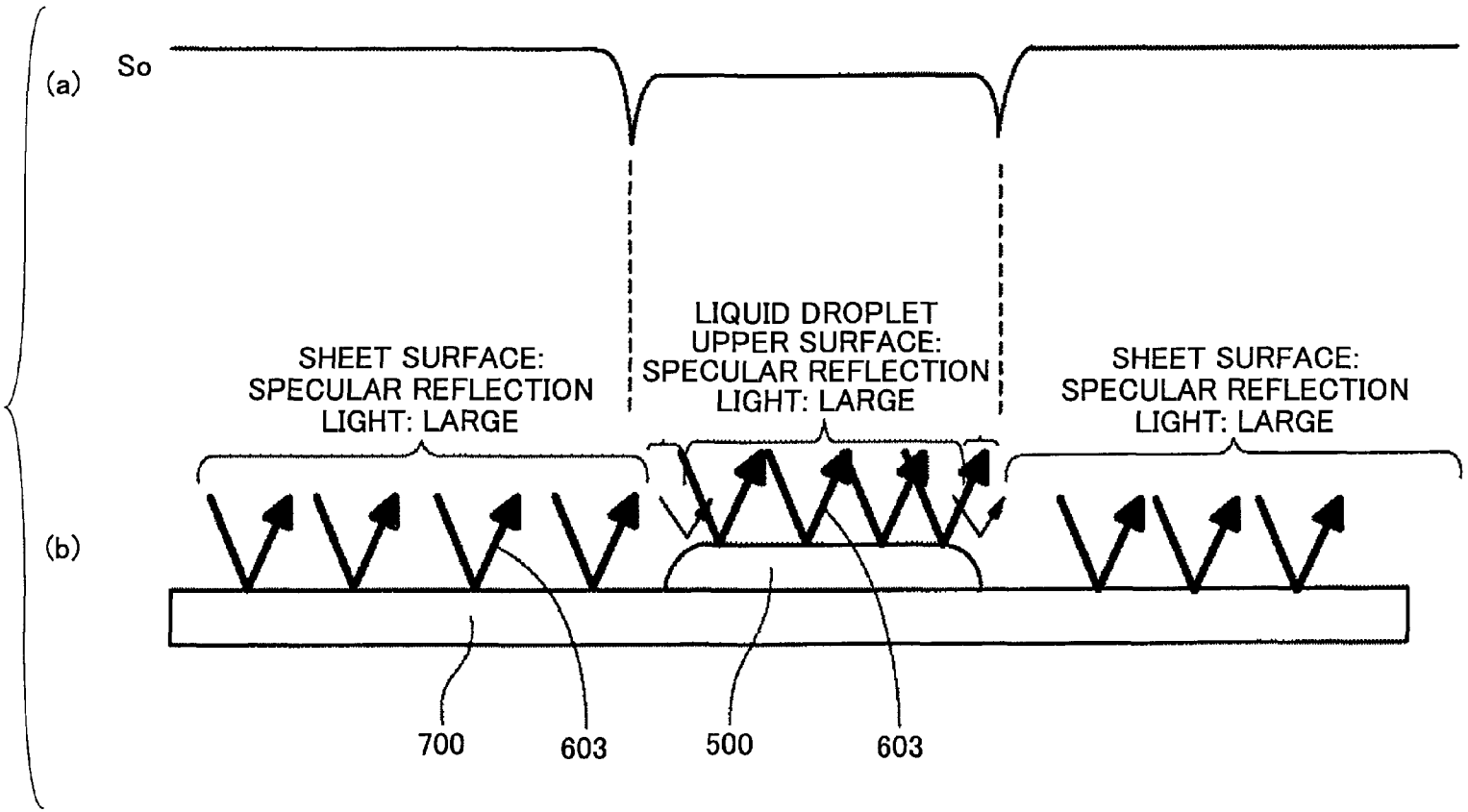
FIG. 14 is a schematic diagram for explaining an adjustment pattern of a comparative example.

If, as shown in FIG. 14-(*a*), plural ink droplets come in contact with one another on the water repellent sheet 700 to form a bigger ink droplet 500, the upper surface of the ink droplet 500 becomes flat, resulting in increasing the amount of the specular reflection light 603. Accordingly, as shown n FIG. 14-(*b*), the output level of the sensor output voltage generated when on the surface of the water repellent sheet 700 is substantially the same as that generated when on the surface of the ink droplet 500, which makes it difficult to detect the position of the ink droplet 500. Although the light is scattered at the edge of the ink droplet 500 formed of ink droplets connected to one another, the area of the portion that returns scattered reflection light is very limited. To detect such an ink droplet 500 formed of connected droplets, the detection area of the light receiving element 403 needs to be reduced. Furthermore, noise elements such as a small scratch and dust on the surface of the water repellent sheet 700 may lower the detection accuracy, resulting in reduced reliability of the detection result.

As described above, the impact position of an ink droplet can be detected by identifying a portion with attenuated specular reflection light in the output of the light receiving unit that receives specular reflection light from the ink droplet. For accurate detection of the impact position of an ink droplet, the adjustment pattern 400 needs to be formed of plural ink droplets independently and densely disposed in the detection region of the pattern reading sensor 401 (adjustment pattern 400 needs to be formed such that, in the detection region, the area of the space between ink droplets is smaller than the area to which the ink droplets are attached). Forming such an adjustment pattern enables high accuracy detection of the adjustment pattern (the liquid droplet impact position) using a simple configuration including a light emitting element and a light receiving element.

The difference between toner particles of the electrophotographic system and liquid droplets of a liquid ejection system is described below.

Figure 15:
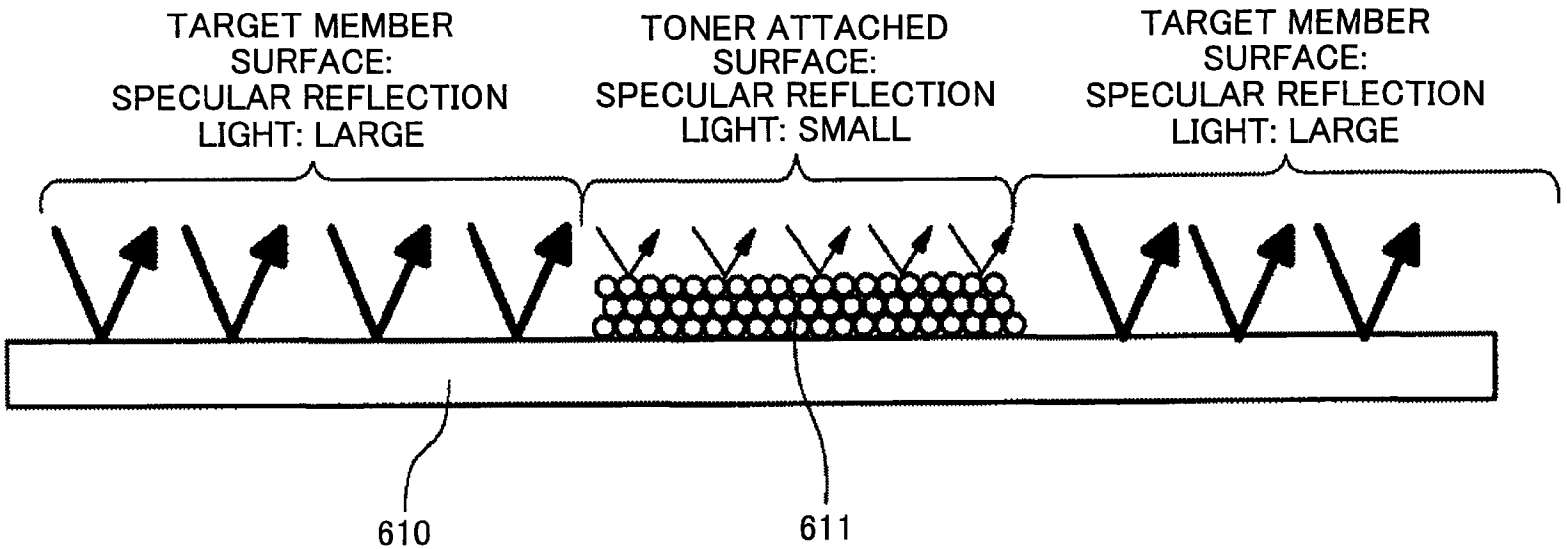
FIG. 15 is a schematic diagram for explaining a comparative example using a toner.

Toner particles of the electrophotographic system maintain their shapes even when attached to a target member 610. Therefore, as shown in FIG. 15, even when toner particles 611 forming an adjustment pattern are stacked one on another on the target member 610, the amount of specular reflection light from the toner attached surface is smaller than the amount of the specular reflection light from the target member 610. Accordingly, it is possible to detect the adjustment pattern based on the output from a light receiving element that receives specular reflection light.

On the other hand, liquid droplets are connected to one another upon impact with a target member to form a flat upper surface, so that the amount of specular reflection light from the upper surface of the connected liquid droplets is substantially the same as the amount of reflection light from the surface of the target member. This characteristic is unique to liquid droplets. Using a system for detecting an adjustment pattern based on a variation of the amount of received specular reflection light from the adjustment pattern without taking this unique characteristic of liquid droplets into consideration can result in a significant reduction of detection accuracy. Moreover, if an adjustment pattern is formed by ejecting ink droplets on a recording medium into which ink can penetrate, it is impossible to accurately detect the pattern.

According to an embodiment of the present invention, in view of these characteristics of liquid droplets, an adjustment pattern formed of plural independent liquid droplets and formed such that, in the detection region, the area of the space between the ink droplets is smaller than the area to which the liquid droplets are attached. This adjustment pattern can be detected with high accuracy based on a variation of the amount of received specular reflection light from the adjustment pattern. This enables accurate detection (correction) of displacement of the impact position of a liquid droplet.

The following describes different examples of detection processing (reading processing) of an adjustment pattern 400 formed on a water repellent sheet 700 is described below with reference to FIGS. 16-18.

Figure 16:
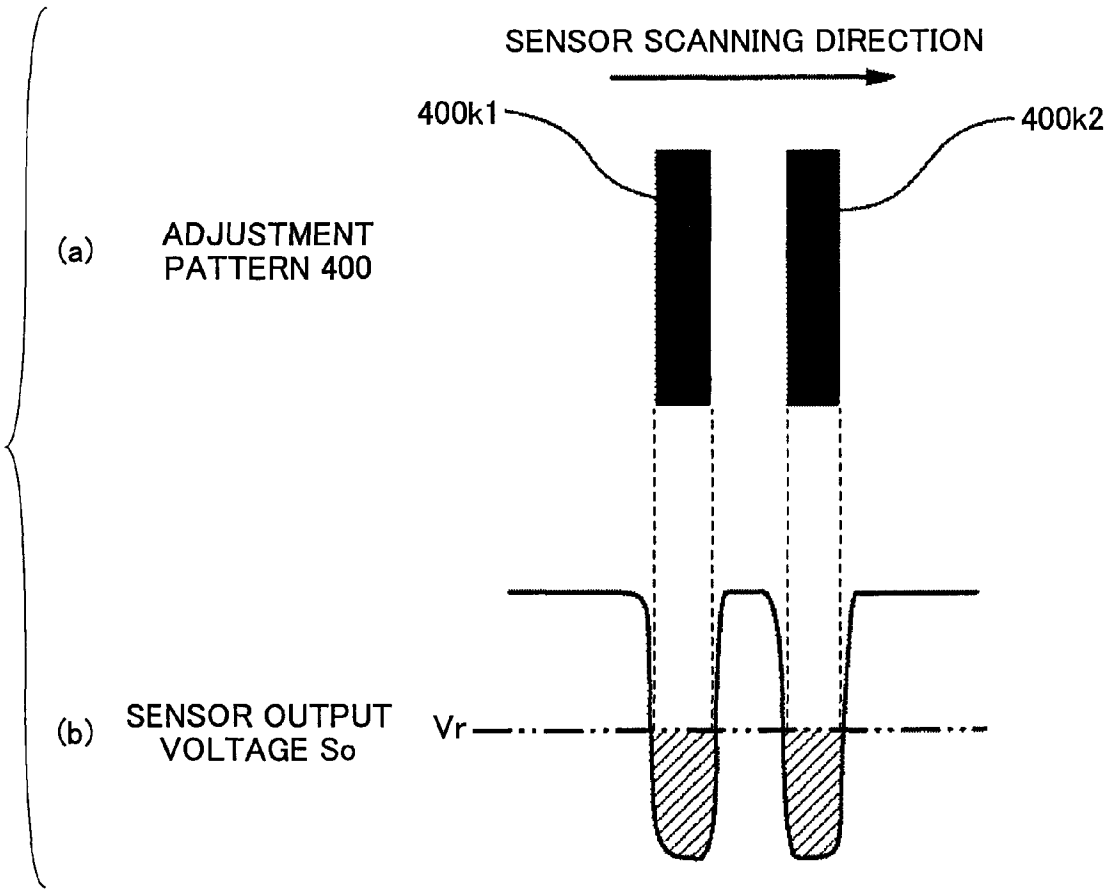
FIG. 16 is a diagram for explaining a first example of adjustment pattern position detection processing.

In a first example shown in FIG. 16, for example, on a water repellent sheet 700, a line-shaped pattern 400*k*1 is formed by the recording head 24*k*1, and a line-shaped pattern 400*k*2 are formed by the recording head 24*k*2 as shown in FIG. 16-(*a*). The patterns 400*k*1 and 400*k*2 are scanned by the pattern reading sensor 401 in the sensor scanning direction (carriage main scanning direction). Based on the output result of the light receiving element 403 of the pattern reading sensor 401, a sensor output voltage So can be obtained that falls in response to the patterns 400*k*1 and 400*k*2 as shown in FIG. 16-(*b*).

The sensor output voltage So is compared with a threshold Vr. The positions at which the sensor output voltage So falls below the threshold Vr are detected as edges of the pattern 400*k*1 and 400*k*2. The area centroids of regions (indicated by hatching in FIG. 16-(*b*)) enclosed by the line of the threshold Vr and the line of the sensor output voltage So are calculated, and the calculated area centroids are used as the centers of the patterns 400*k*1 and 400*k*2. With use of this centroid, it is possible to reduce errors due to small fluctuations of the sensor output voltage.

Figure 17A:
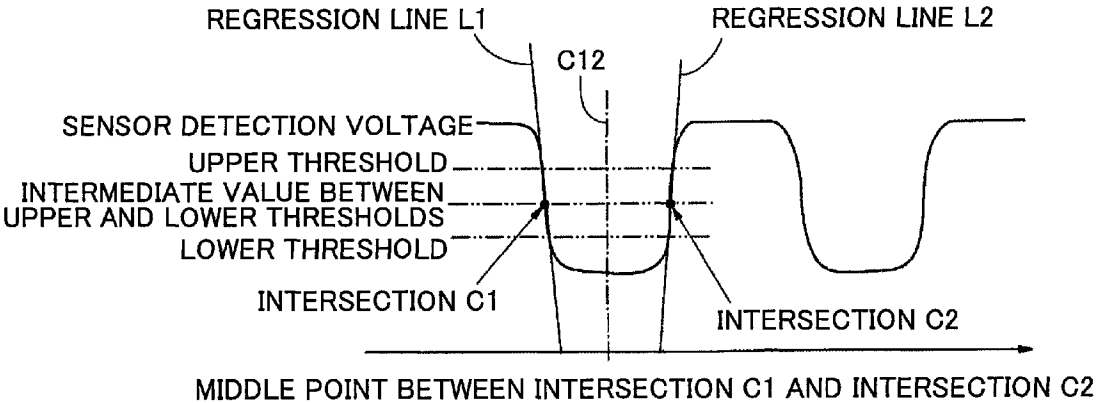
FIGS. 17A and B are diagrams for explaining a second example of adjustment pattern position detection processing.
Figure 17B:
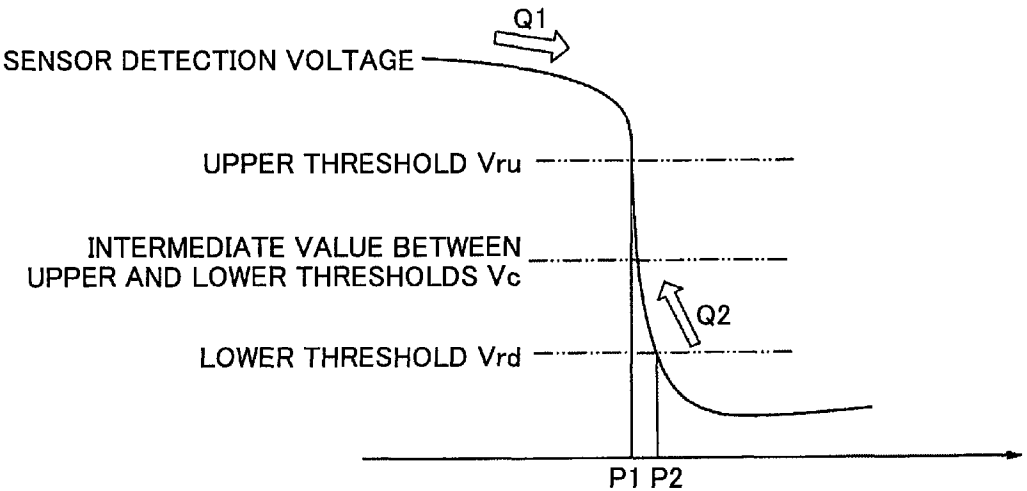

In a second example shown in FIGS. 17A and 17B, patterns 400*k*1 and 400*k*2 similar to the patterns 400*k*1 and 400*k*2 of FIG. 16 are scanned by the pattern reading sensor 401, thereby obtaining a sensor output voltage as shown in FIG. 17A. FIG. 17B is an enlarged view of the falling edge of the sensor output voltage So.

The falling edge of the sensor output voltage So is searched in the direction indicated by the arrow Q1 of FIG. 17B to detect a point at which the sensor output voltage So falls below a lower threshold Vrd, and the detected point is stored as a point P2. Then, the falling edge is searched from the point P2 in the direction indicated by the arrow Q2 to detect a point at which the sensor output voltage So exceeds an upper lower threshold Vru, and the detected point is stored as a point P2. A regression line L1 is calculated for the output voltage So between the point P1 and the point P2. Using the equation describing the regression line L1, an intersection C1 of the regression line L1 and the line indicating the intermediate value Vrc between the upper and lower thresholds is calculated. Similarly, a regression line L2 for the rising edge of the sensor output value So is calculated, and then an intersection C2 of the regression line L2 and the line indicating the intermediate value Vrc between the upper and lower thresholds is calculated. Then, based on the intersections C1 and C2, a line center C12 as the middle point between the intersection C1 and the intersection C2 is calculated by the following expression: (the intersection C1+the intersection C2)/2.

Figure 18:
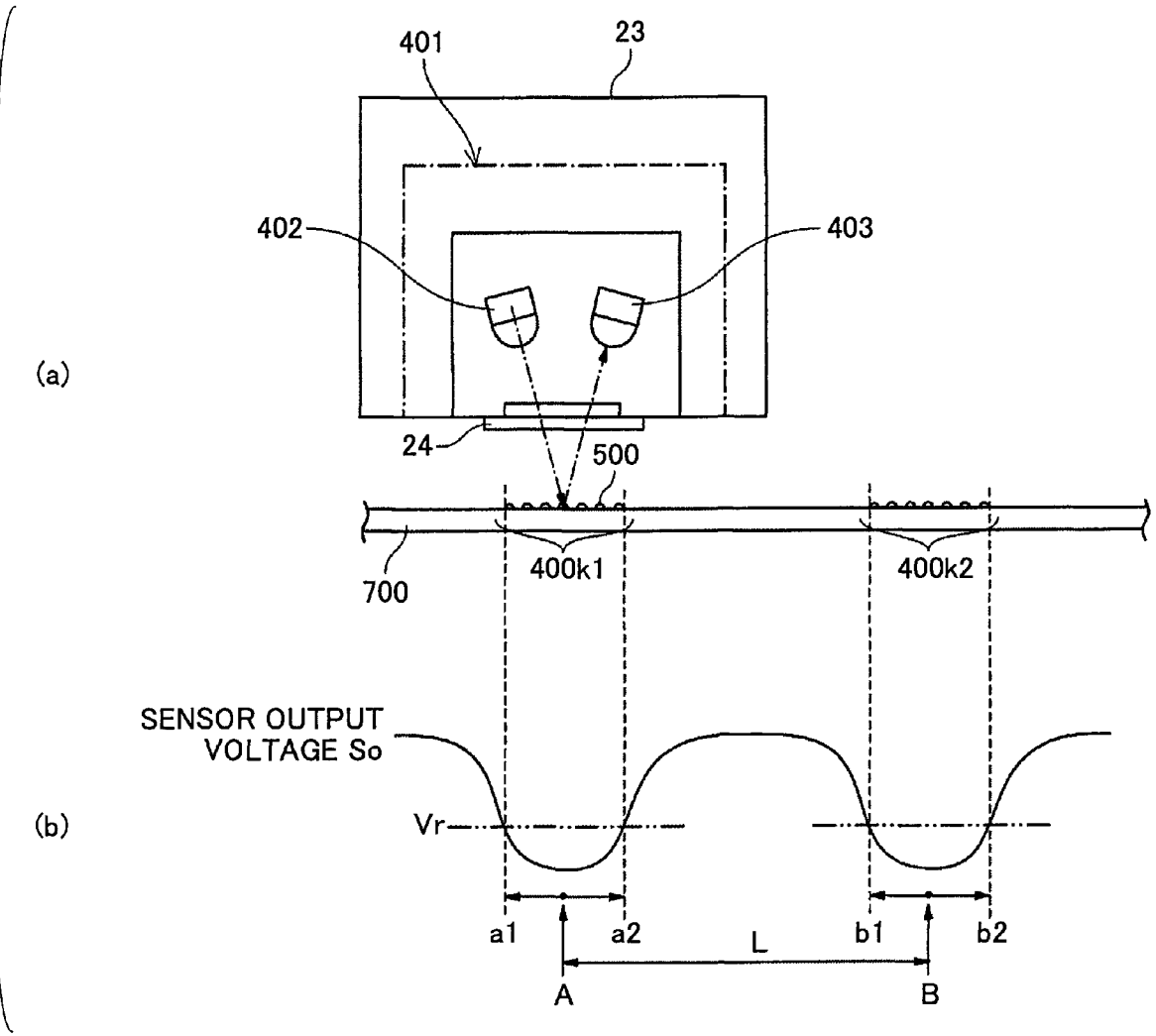
FIG. 18 is a diagram for explaining a third example of adjustment pattern position detection processing.

In a third example shown in FIG. 18, as in the first example, a line-shaped pattern 400*k*1 is formed on a water repellent sheet 700 by the recording heads 24*k*1, and a line-shaped pattern 400*k*2 is formed by the recording head 24*k*2 as shown in FIG. 18-(*a*). The line-shaped patterns 400*k*1 and 400*k*2 are scanned by the pattern reading sensor 401 in the main scanning direction as in the case of the first example. As a result, a sensor output voltage (photoelectrically converted voltage) as shown in FIG. 18-(*b*) is obtained.

The above-mentioned processing algorithm 526 removes harmonic noise using an IIR filter, evaluates the quality of the detection signal (missing portions, instability, surplus), and detects slopes near the threshold value Vr to calculate a regression curve. Then, the processing algorithm 526 calculates intersections a1, a2, b1, and b2 of the regression curve and the line indicating the threshold Vr (using a position counter comprising an Application Specific Integrated Circuit (ASIC)), calculates a middle point A between the intersections a1 and a2 and a middle point B between the intersections b1 and b2, and calculates a distance L between the middle point A and the middle point B. Thus, center positions of the pattern 400*k*1 and the pattern 400*k*2 are calculated.

The difference between the ideal distance between the recording head 24*k*1 and the recording head 24*k*2 and the calculated distance L is calculated by the following expression: the ideal head-to-head distance−the distance L. This difference is the displacement amount on the actual printed result. Based on the calculated displacement amount, correction amounts for correcting timings (liquid droplet ejection timings) for ejecting liquid droplets from the recording heads 24*k*1 and 24*k*2 are calculated and set in the liquid droplet ejection control unit 502. Thus, the liquid droplet ejection control unit 502 drives the recording heads 24*k*1 and 24*k*2 with corrected liquid eject timings, thereby reducing the positional displacement.

Examples of adjustment patterns 400 formed of ink droplets having different shapes are described with reference to FIG. 19 through FIG. 21B.

Figure 19:
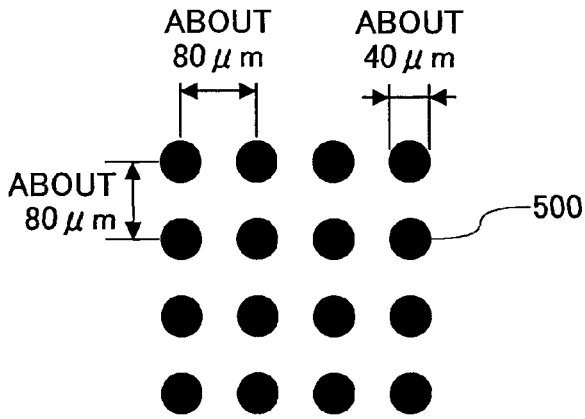
FIG. 19 is a diagram for explaining a first example of the shape of impacted droplets which form an adjustment pattern.

FIG. 19 shows an example in which plural liquid droplets 500 are independently disposed in a lattice form.

Figure 20A:
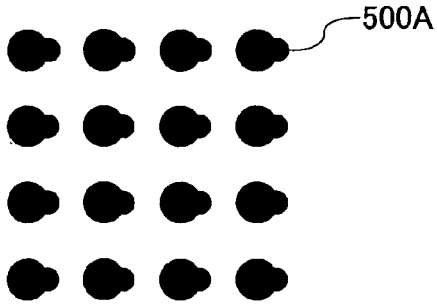
FIGS. 20A and 20B are diagrams for explaining a second example of the shape of impacted droplets which form an adjustment pattern.
Figure 20B:
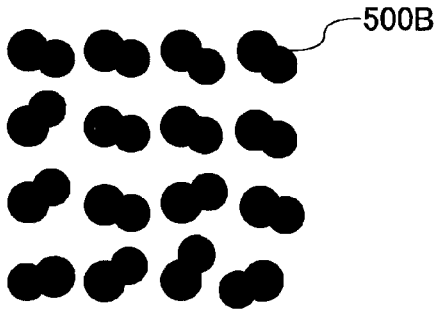

FIG. 20A shows an example in which plural independent liquid droplets 500A, each formed of a large droplet (e.g., a main droplet) and a small droplet (e.g., a satellite droplet, a small droplet) connected to each other, are disposed in a lattice form. FIG. 20B shows an example in which plural independent liquid droplets 500B are disposed, each formed of two liquid droplets of the substantially same size connected to each other.

Figure 21A:
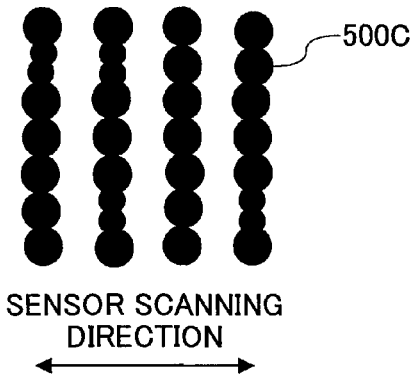
FIGS. 21A and 21B are diagrams for explaining a third example of the shape of impacted droplets which form an adjustment pattern.
Figure 21B:
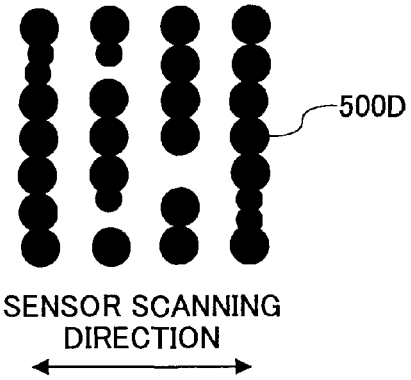

FIG. 21A shows an example in which line-shaped liquid droplets 500C, each formed of droplets connected to one another in the direction orthogonal to the scanning direction of the pattern reading sensor 401, are disposed in the sensor scanning direction. FIG. 21B shows an example in which plural line-shaped liquid droplets 500D (having the same length or different lengths), which are similar to the droplets 500C of the example of FIG. 21A except that some of the liquid droplets 500D have a missing portion(s), are disposed in the sensor scanning direction.

Figure 22A:
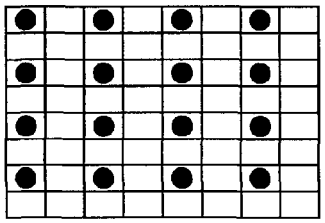
FIGS. 22A-22C are diagrams illustrating adjustment patterns with different layouts of droplets.

A configuration for detecting the impact position with higher accuracy is described below with reference to FIG. 22A through FIG. 23.

First, the ratio of the diffused reflection light relative to the entire reflection light from the adjustment pattern 400 is made constant. More specifically, as in the ejected ink droplets shown in the center of FIG. 13, liquid droplets 500 are ejected such that the reflected light from the adjustment pattern 400 is uniformly diffused. This achieves high reproducibility of a sensor output voltage to be processed by the processing algorithm 526, making it possible to produce the high-accuracy adjustment pattern 400 (liquid droplet impact position) with high accuracy and adjust the displacement of the impact positions of the liquid droplets.

Figure 22B:
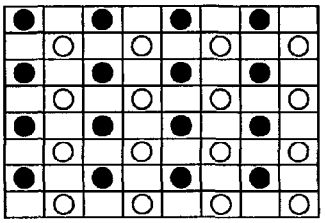
Figure 22C:
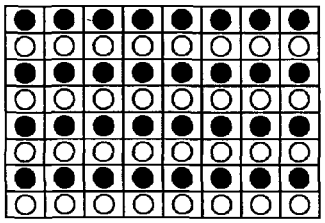

To uniformly diffuse the reflection light from the adjustment pattern 400, the area of the surfaces of the ink droplets from which the diffused reflection light is emitted is made constant. For example, as shown in FIG. 22A, plural ink droplets 500 forming the adjustment pattern 400 are independently disposed at every second dot position. The adjacent ink droplets are regularly attached to a water repellent sheet 700 without being connected to each other, achieving the constant area of the surface that emits the diffused reflection light. As long as the adjacent droplets are independent from one another without being connected, the ink droplets 500 may be disposed in a staggered arrangement as shown in FIG. 22B or may be disposed at every dot position as shown in FIG. 22C.

As shown in FIG. 12, because the ejected ink droplet is dried with time and therefore the diffusion of the reflection light changes, the time from the impact of the ink droplet to the reception of the specular reflection light by the pattern reading sensor 401 may be made constant to provide a reproducibility of the detection potential.

In terms of uniformly diffusing the reflection light, ink droplets each formed of two droplets (e.g., a main droplet and a satellite droplet) connected to each other as shown in FIGS. 21A and 21B may be regularly arranged.

Figure 23:
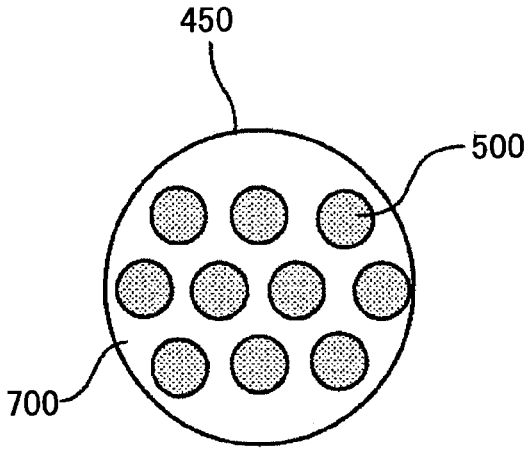
FIG. 23 is a diagram for explaining a droplet contact area in a detection region.

To uniformly diffuse the reflection light from the adjustment pattern 400, as shown in FIG. 23, the contact area of the ink droplets 500 with the water repellent sheet 700 in the detection area (detection region) is made constant. For example, as described above, plural ink droplets 500 forming the adjustment pattern 400 are independently disposed with one-dot space between them. When the liquid droplets 500 are independent from each other and are formed with the constant ejection amount, the contact area of the ink droplets 500 with the surface of the water repellent sheet 700 is made constant. As long as the adjacent ink droplets are independent without being connected to each other, the ink droplets 500 may be disposed in other arrangements such as a staggered arrangement. It is easy to make the contact area constant by using, for example, a combination of pigment ink and a water repellent sheet 700 that repels the pigment ink.

Making the areas of the surfaces of the ink droplets that emit the diffused reflection light and making the contact areas of the ink droplets with the water repellent sheet constant at the same time can produce a synergistic effect, so that the reflection light from the adjustment pattern is more uniformly diffused, thereby making it possible to obtain a detection voltage with a high reproducibility.

Figure 24:
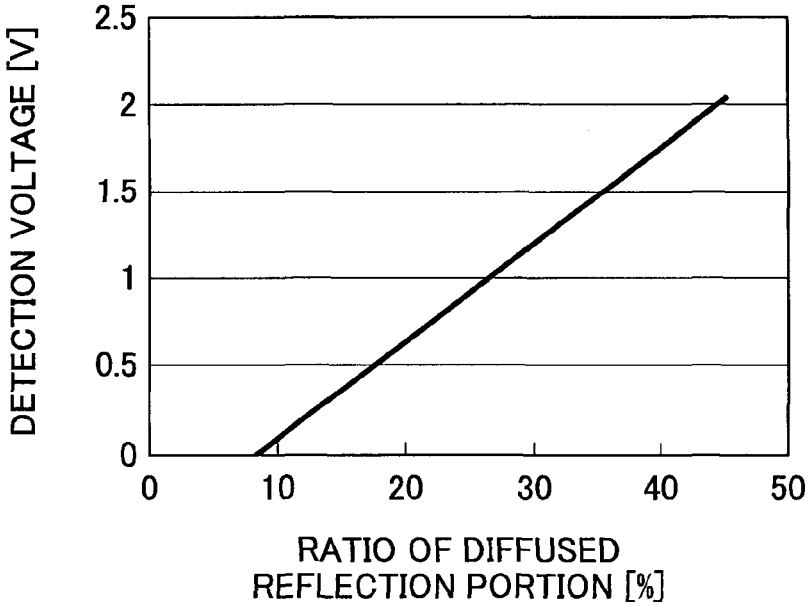
FIG. 24 is a graph showing an approximate relationship between the ratio of the area of a diffuse reflection portion and a detection voltage based on an experimental result.

If the ink droplets are not so densely disposed, the detection output in response to the adjustment pattern 400 does not become high. This needs to be taken into consideration. According to an experimental result, the correlative relationship between the area of diffuse reflection portions of the ink droplets which emit the diffused reflection light and the level of the detection output is approximated by the line shown in FIG. 24. It was found from the experimental result that when the area of the diffuse reflection portions is 10% of the area of the adjustment pattern 400 or greater, a required voltage output can be obtained.

The pattern scattered reflection ratio of the liquid droplets forming the adjustment pattern 400 is described below.

In this application, the ratio of the portion that emits diffused light in the detection area (detection region) scanned by the pattern reading sensor 401 is referred to as "the pattern scattered reflection ratio". The pattern scattered reflection ratio is calculated by the following equation: the pattern scattered reflection ratio=the sum of the area of the scattered reflection portions/the area of the detection region.

Figure 25:
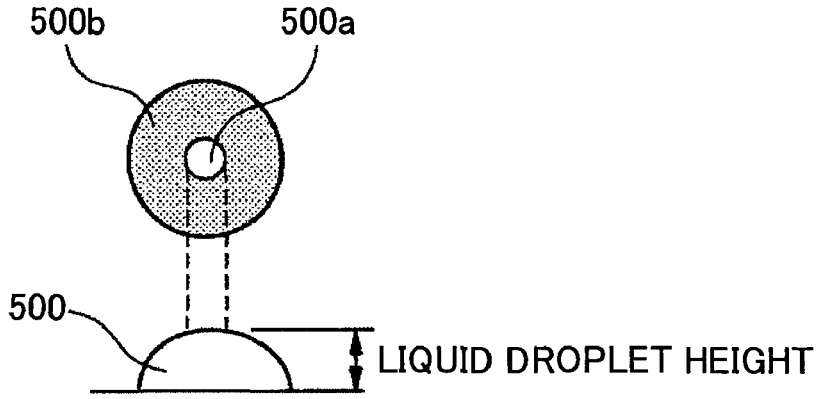
FIG. 25 is a schematic diagram for explaining the pattern scattered reflection ratio.
Figure 26:
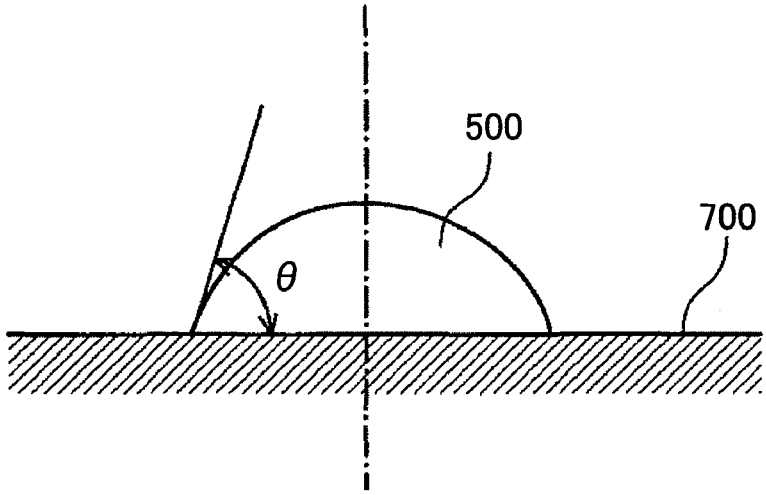
FIG. 26 is a diagram for explaining a contact angle of a liquid droplet.

When the detection region is constant, the pattern scattered reflection ratio can be increased by increasing the area of the scattered reflection portions. As shown in FIG. 25, when an ink droplet 500 is attached to the surface of the water repellent sheet 700, if the wetting efficiency is low (if the contact angle θ of FIG. 26 is small) the ink droplet 500 becomes a hemispherical shape. The outer surface of the hemispherical shaped ink droplet 500 includes a portion 500*a* which returns specular reflection light and a portion 500*b* (scattered reflection portion) which returns diffused reflection light when the light from a constant direction is incident thereon. The pattern scattered reflection ratio can be increased by controlling ejection of ink droplets so as to increase the scattered reflection portion 500*b* of each ink droplet 500 (i.e., so as to increase the droplet scattered reflection ratio).

The droplet scattered reflection ratio refers to the ratio of the scattered reflection portion to the contact area with the water repellent sheet, and is calculated by the following equation: the droplet scattered reflection ratio=the area of the scattered reflection portion of a single droplet/the contact area with the water repellent sheet.

As the liquid droplets used for forming the adjustment pattern 400, liquid droplets for image formation of the maximum ejection amount (the maximum drop volume) are preferably used. That is, the adjustment pattern 400 is formed by ejecting liquid droplets in a print mode that ejects droplets of the maximum volume. Thus, the height of the liquid droplet 500 of FIG. 25 is increased, so that the droplet scattered reflection ratio is increased.

The shapes of the liquid droplets 500 may differ due to the difference in the composition of color inks (cyan, magenta, yellow, and black). The droplet scattered reflection ratio can be increased by ejecting liquid droplets of ejection amounts (droplet volumes) according to the color of the liquid droplets.

As described above, in the case of forming an adjustment pattern on a water repellent sheet using an image forming apparatus including liquid droplet ejection units (recording heads) for ejecting liquid droplets; a unit that forms an adjustment pattern formed of plural independent liquid droplets for detecting liquid droplets impact positions; a reading unit that includes a light emitting unit for emitting light onto the adjustment pattern and a light receiving unit for receiving specular reflection light from the adjustment pattern; and an impact position correcting unit that corrects an impact position of a liquid droplet to be ejected from the recording head by calculating the impact position displacement amount based on a damping signal of the specular reflection light output from the reading unit a read result by the reading unit, when ejection of liquid droplets is controlled to maximize the pattern scattered reflection ratio of the adjustment pattern to be formed of the liquid droplets, it is possible to increase the output sensitivity of the light receiving unit (sensor) and improve the displacement amount detection performance and the reading performance such as repeat accuracy.

Furthermore, by controlling the liquid droplet ejection unit to maximize the scattered reflection area (droplet scattered reflection ratio) of each single liquid droplet, it is possible to further increase the detection sensitivity and accuracy. The scattered reflection area is maximized preferably by (1) controlling the ejection amount of the liquid droplet, (2) controlling the ejection amount of the liquid droplet according to the color of the liquid droplet, (3) minimizing the time lag between the ejection of the liquid droplet for forming the adjustment pattern and the emission/reception of light for reading the pattern, more preferably by performing the ejection of the liquid droplet and the emission/reception of light at the same time by one action, (4) using a combination of a water repellent sheet and a liquid droplet that achieves greater contact angle, (5) ejecting the liquid droplet such that the liquid droplet in contact with the water repellent sheet has a circular shape or a shape of two connected circles as shown in FIG. 20A, and (6) controlling the liquid ejection such that the liquid droplets are independent from each other and such that the area of the liquid droplets in the detection area of the light emitting unit and the light receiving unit is maximized by, for example, controlling the arrangement of the liquid droplets and minimizing the space between the liquid droplets.

The following describes formation and detection of the adjustment pattern 400. As mentioned above, because the shape of the ink droplet changes over time due to evaporation of moisture from the ink droplet after the ink droplet is attached to the water repellent sheet, the specular reflection light increases with time, so that the output voltage of the pattern reading sensor 401 is reduced.

To accurately detect the impact position of the ink droplet, it is preferable to detect the adjustment pattern 400 by the pattern reading sensor 401 immediately after forming the adjustment pattern 400. Therefore, the speed of reading the adjustment pattern 400 is set at the same speed as the speed of forming the adjustment pattern 400, and the adjustment pattern 400 is read immediately after the adjustment pattern 400 is formed. To read the adjustment pattern 400 immediately after forming the adjustment pattern 400, the pattern reading sensor 401 is disposed upstream of the carriage 23 in the scanning direction in which the carriage 23 prints the adjustment pattern 400. However, this configuration is possible only in the forward path or the backward path.

For this reason, the print speed of forming the adjustment pattern 400 is set at a speed different from the speed of reading the adjustment pattern 400, and the adjustment pattern 400 is printed on the water repellent sheet 700 and then is detected without rotating the transport belt 31. In this case, the pattern reading sensor 401 is located above the area where the adjustment pattern 400 is to be formed.

Figure 27:
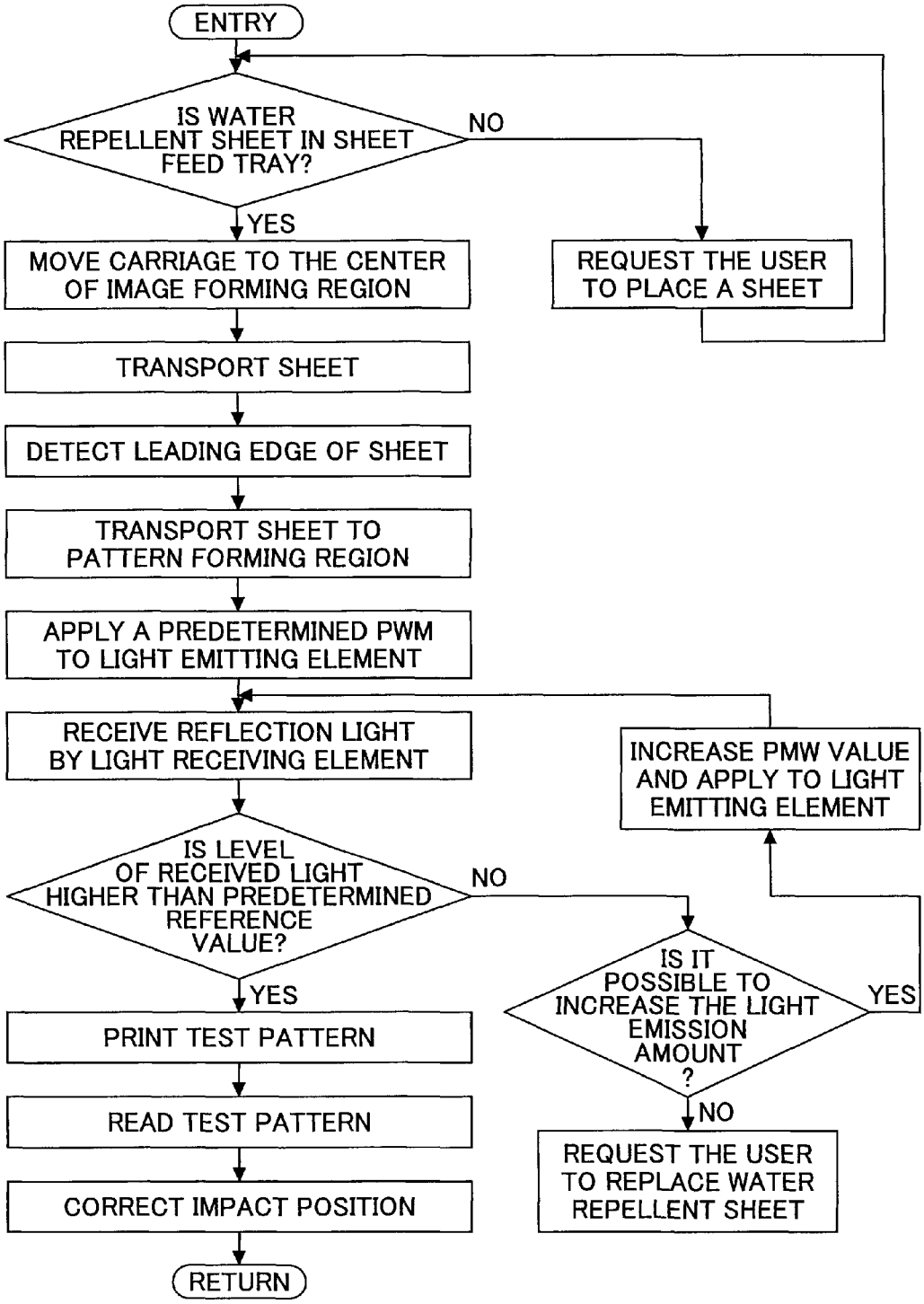
FIG. 27 is a flowchart illustrating droplet impact position detection and droplet impact position adjustment.

Correction of displacement of the liquid droplet impact position by the main control unit 310 of this embodiment is described below with reference to FIG. 27.

When an instruction for an operation of correcting the liquid droplet impact position is entered from, e.g., the operations panel (not shown), the main control unit 310 determines whether a water repellent sheet 700 is in the sheet feed tray (or in the manual sheet feed tray). If a water repellent sheet 700 is not in the sheet feed tray, a user is requested to place a water repellent sheet 700 in the feed tray.

When a water repellent sheet 700 is placed, the carriage 23 is moved to the center of the image forming region in the main scanning direction. The water repellent sheet 700 is transported until the sheet detection sensor 330 detects the water repellent sheet 700, and then is transported to the adjustment pattern forming region. After that, the light emitting element 402 of the pattern reading sensor 401 is driven according to a predetermined PWM value (e.g. 50% duty). The reflected light from the water repellent sheet 700 is received by the light receiving element 403 of the pattern reading sensor 401, and it is determined that the level of the received light is higher than a predetermined reference value (a predetermined level). If the level of the received light is not higher than the reference value, it is determined whether the light emission amount can be increased. If the light emission amount can be increased, the light emission amount of the light emitting element 402 of the pattern reading sensor 401 is increased by increasing the PWM value, and then the light emitting element 402 is driven again. Then process returns to the operation of comparing the light reception level with the reference value. If the light emission amount cannot be increased, the user is requested to replace the water repellent sheet 700 by another water repellent sheet 700.

If the level of the received light level is higher than the predetermined level, an adjustment pattern (test pattern) 400 is formed on the water repellent sheet 700, and the pattern reading sensor 401 reads the test pattern 400. Based on the read result, the amount of positional displacement is calculated. Then, based on the calculated positional displacement amount, impact position correction by changing the timing of ejecting liquid droplets is performed.

Block patterns (also referred to as "basic patterns") corresponding to the smallest items constituting the adjustment pattern 400 of this embodiment of the present invention for detecting a displacement of the impact position is described below with reference to FIGS. 28A-28D.

As mentioned above, according to the impact position displacement correction method used by this image forming apparatus, a line-shaped pattern is formed by a recording head (of a color) as a reference recording head in the direction orthogonal to the transport belt rotating direction, and similar line-shaped patterns are formed by other recording heads (of other colors) at intervals. Then the distance from the reference head is calculated.

Figure 28A:
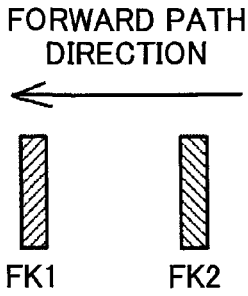
FIGS. 28A-28D are diagrams for explaining a block pattern.
Figure 28C:
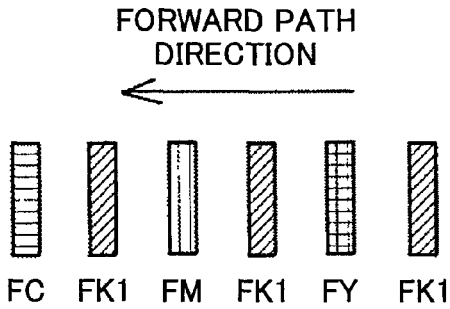
Figure 28B:
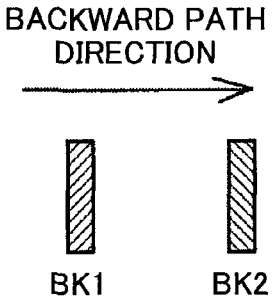
Figure 28D:
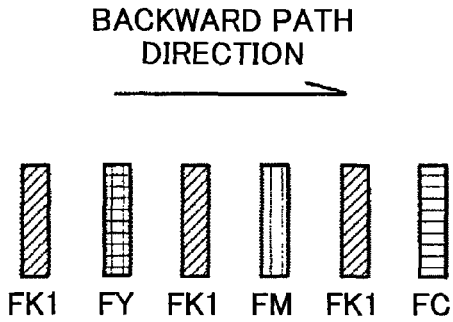

The basic patterns corresponding to the smallest items includes the following four patterns: a pattern of FIG. 28A for detecting the displacement of the impact position of a pattern FK2 formed by the recording head 24*k*2 with reference to a pattern FK1 formed by the recording head 24*k*1 in the forward path (at a first scan); a pattern of FIG. 28B for detecting the displacement of the impact position of a pattern BK2 formed by the recording head 24*k*2 with reference to a pattern BK1 formed by the recording head 24*k*1 in the backward path (at a second scan); a pattern of FIG. 28C for detecting the displacement of the impact positions of patterns FC, FM, and FY respectively formed by the recording heads 24*c*, 24*m*, and 24*y* with reference to patterns FK1 formed by the recording head 24*k*1 in the forward path (at a third scan); and a pattern of FIG. 28D for detecting the displacement of the impact positions of patterns FC, FM, and FY respectively formed by the recording heads 24*c*, 24*m*, and 24*y* with reference to patterns FK1 formed by the recording head 24*k*1 in the backward path (at a fourth scan). An adjustment pattern that serves various detections can be formed by combining these block patterns.

The adjustment patterns for monochrome ruled line misalignment and color misregistration are described below with reference to FIGS. 29, 30A, and 30B.

Figure 29:
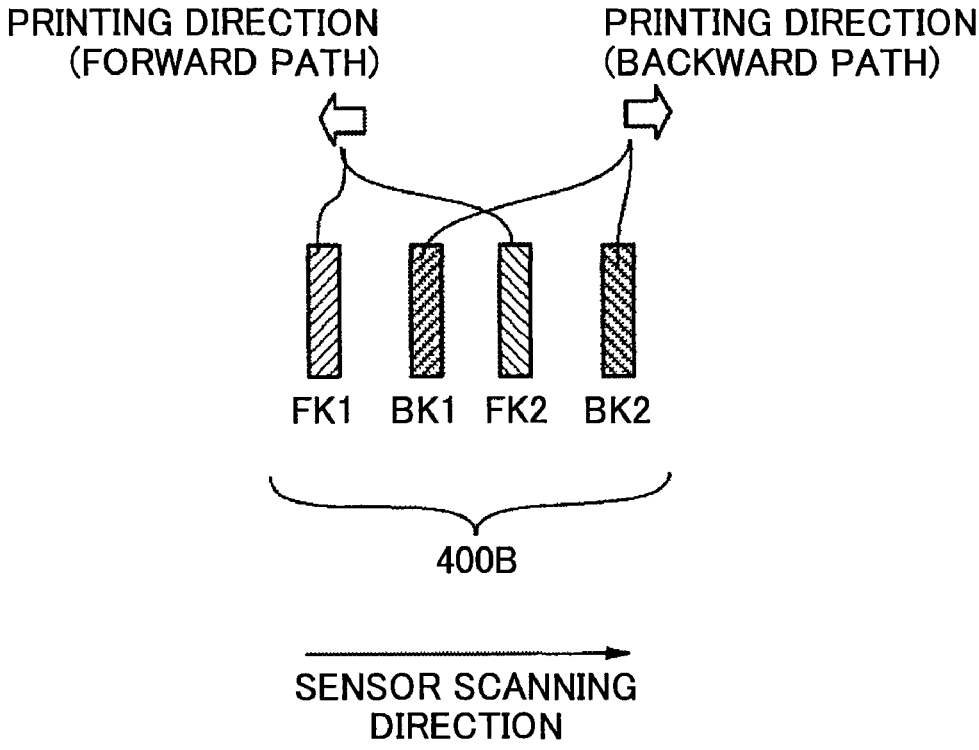
FIG. 29 is a diagram for explaining a ruled line misalignment adjustment pattern.

A ruled line misalignment adjustment pattern 400B shown in FIG. 29 is formed by printing to-be-measured patterns with predetermined intervals with reference to the position of a pattern FK1 (reference pattern) in a reference direction (the forward path). The to-be-measured patterns are a pattern BK1 in the backward path, a pattern FK2 in the forward path, and a pattern BK2 in the backward path. The displacement of the patterns BK1, FK2, and BK2 from the reference pattern FK1 can be detected based on the positional information of the patterns FK1, BK1, FK2, and BK2. In this example, the patterns are read in one sensor scanning direction (read direction).

Figure 30A:
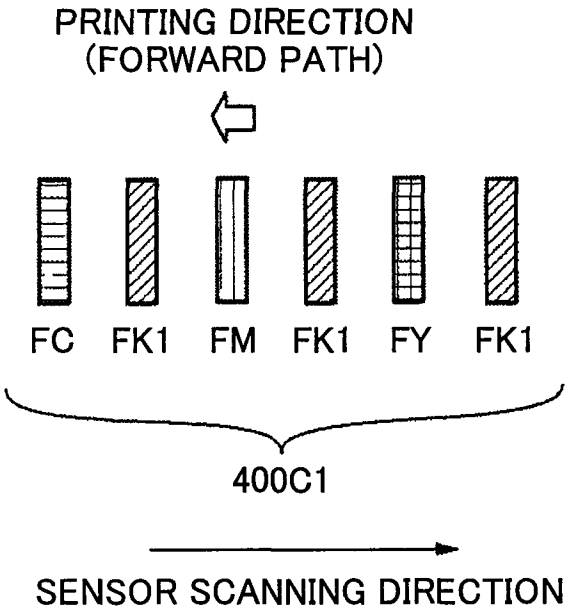
FIGS. 30A and 30B are diagrams for explaining a color misregistration adjustment pattern.
Figure 30B:
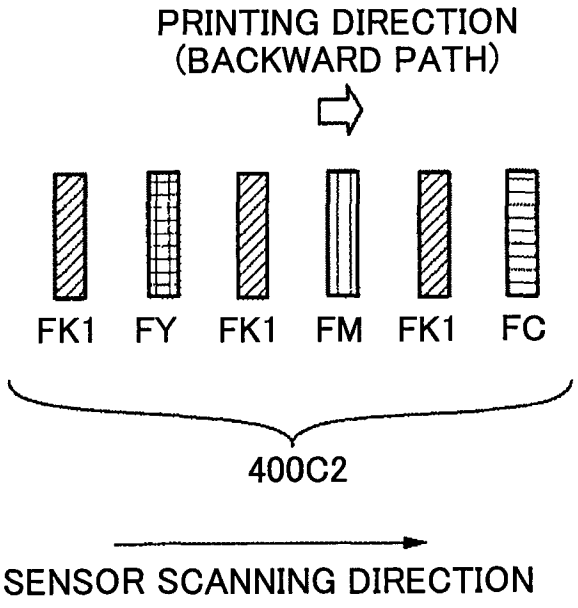

Each of color misragistration adjustment patterns 400C1, 400C2 shown in FIGS. 30A and 30B is formed by printing to-be-measured patterns at positions spaced apart by predetermined distances from corresponding reference patterns of a reference color (in theses examples, patterns FK1 by the recording head 24*k*1 are the reference patterns). The to-be-measured patterns are patterns FY, FM, and FC of other colors. The positions of the to-be-measured patterns with respect to their corresponding reference patterns FK1 can be detected by detecting the positions of the reference patterns FK1 and the to-be-measured patterns FY, FM, and FC. In this example, patterns are read in one sensor scanning direction (read direction).

A specific example of forming an adjustment pattern is described with reference to FIG. 31.

In this example, with regard to the carriage 23, the direction from the back side of the apparatus toward the front side of the apparatus (see FIG. 2) is defined as the forward path direction, and the direction from the front side of the apparatus toward the back side of the apparatus is defined as the backward path direction. The recording heads 24*c*, 24*k*1, 24*k*2, 24*m*, and 24*y* are arranged in this order from the downstream side in the forward path direction (from the front side of the apparatus).

In this example, ruled line misalignment adjustment patterns 400B1 and 400B2 are formed at the opposite sides on the water repellent sheet 700 and color misregistration adjustment pattern 400C1 and 400C2 are formed at the center of the water repellent sheet 700. That is, plural block patterns are formed within the width of a print area in the direction orthogonal to the direction of transporting the water repellent sheet 700.

The pattern reading sensor 401 performs plural read operations after the adjustment patterns 400B1, 400B2, 400C1 are printed. The pattern reading sensor 401 may perform read operations in one reading direction, or may perform read operations in two opposite reading directions.

For example, the carriage 23 moves in the forward path direction to sequentially read the adjustment patterns 400B1, 400C1, 400C2, 400B2 and detects the positions of line-shaped patterns of each of the adjustment patterns. Then, for example, in the adjustment pattern 400B1, the distance between a pattern FK1 as a reference pattern and a pattern BK1 as a to-be-measured pattern is calculated, thereby obtaining the displacement amount of the impact position of the recording head 24*k*1 in the backward path with respect to the impact position in the forward path.

Further, in the adjustment pattern 400B1, the distance between the pattern FK1 as a reference pattern and a pattern BK2 as a to-be-measured pattern is calculated, thereby obtaining the displacement amount of the distance between the patterns FK1 and BK2 with respect to the actual head-to-head distance between the recording head 24*k*1 and 24*k*2.

Further, in the pattern 400C1, with reference to the pattern FK1, the distances to the patterns FY, FM, and FC from the corresponding reference patterns FK1 are calculated, thereby obtaining the displacement amounts of the distances between the patterns FY, FM, and FC from the corresponding reference patterns FK1 with respect to the actual head-to-head distances from the recording head 24*k*1 to the recording heads 24*y*, 24*m*, and 24*c*.

In order to increase the detection accuracy, the patterns 400B1, 400B2, 400C1, and 400C2 are read plural times, and the average values of the plural read results are calculated.

The timings of ejecting liquid droplets from the recording heads 24*k*1, 24*k*2, 24*y*, and 24*c* are controlled (changed) according to the calculated displacement result, thereby aligning the positions of liquid droplets to be ejected from the recording heads 24*k*1, 24*k*2, 24*y*, and 24*c*.

As described above, an impact position adjustment pattern formed of plural independent liquid droplets on a water repellent surface is formed on a water repellent surface constituting at least a part of the surface of a water repellent sheet. A light emitting unit emits light onto the adjustment pattern, and a light receiving element receives specular reflection light from the adjustment pattern, thereby detecting the adjustment pattern. Based on the detection result of the adjustment pattern, the impact position of a liquid droplet to be ejected from a recording head is corrected. Thus, it is possible to accurately detect the impact positions of the liquid droplets with a simple configuration and accurately correct displacement of the liquid droplet impact position.

An example of the water repellent sheet 700 used in an embodiment of the present invention is described below with reference to FIG. 32.

Figure 32:
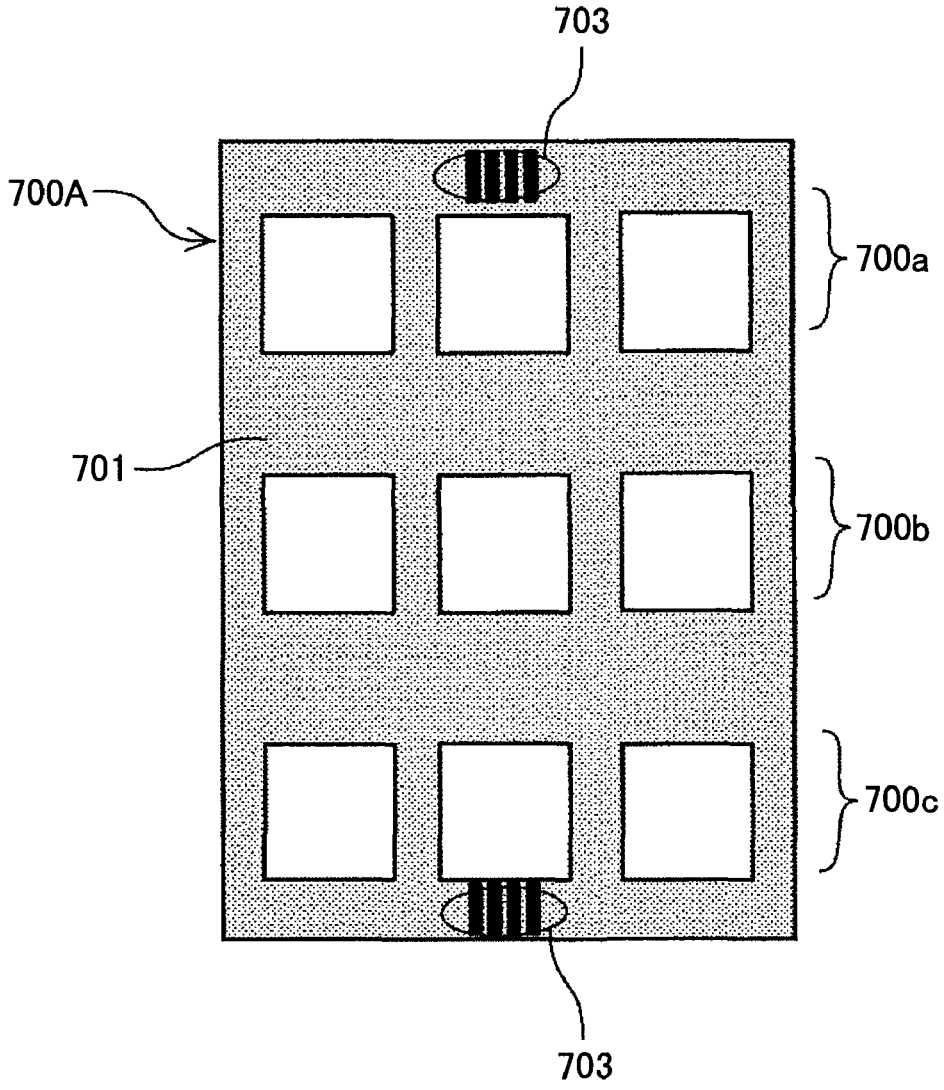
FIG. 32 is a diagram for explaining an example of a water repellent sheet.

A water repellent sheet 700A of FIG. 32 includes a water repellent region 701 formed by coating a part of the surface with a water repellent agent. In this example, a total of nine water repellent regions 701 are formed, including three in an upper part 700*a*, three in a center part 700*b*, and three in a lower part 700*c* in the direction of transporting the water repellent sheet 700A. Identification marks 703 indicative of a water repellent sheet are provided at the leading edge and the trailing edge of the water repellent sheet 700A in the transporting direction. As the marks 703, a two-dimensional pattern such as a barcode, a three-dimensional pattern having raised and recessed portions, magnetic patterns and other suitable patterns may be used.

When forming adjustment patterns 400 on this water repellent sheet 700A, an adjustment pattern 400 can be formed on the water repellent region 701 of the upper part 700*a* of the water repellent sheet 700A upon a first impact position displacement correction; another adjustment pattern 400 may be formed on the water repellent region 701 of the center part 700*b* of the water repellent sheet 700A upon a second impact position displacement correction; and another adjustment pattern 400 may be formed on the water repellent region 701 of the lower part 700*c* of the water repellent sheet 700A upon a third impact position displacement correction.

In this case, when the water repellent sheet 700A is loaded, the water repellent sheet 700A is scanned at a predetermined location to determine whether an adjustment pattern 400 is already formed. Based on the scan result, the water repellent region to be used may be determined.

In this way, by printing the adjustment patterns 400 in the upper part, the center part, and the lower part, it is possible to perform impact position displacement correction while taking into consideration warpage due to the resilience of the water repellent sheet. Further, by forming plural patterns across the entire surface of the water repellent sheet and detecting the patterns plural times, it is possible to improve the reading performance such as repeat accuracy. The water repellent region may preferably have higher specular reflection ratio, higher gloss level, and higher smoothness relative to a to-be-recording medium commonly used for image formation by the image forming apparatus, e.g., plain paper as a recording medium into which ink can penetrate.

The specular reflection ratio as used herein referrers to the ratio of a specular reflection portion on the impact surface to a detection region 450 of the pattern reading sensor 401, and is calculated by the following equation: the specular reflection ratio=the sum of the area of the specular reflection portions/the area of the detection region. The use of a water repellent sheet having high specular reflection ratio reduces the scattered reflection ratio on the surface of the water repellent sheet, thereby increasing the sensitivity. The higher the gloss level and smoothness of the water repellent sheet, the higher the specular reflection ratio. Therefore, it is preferable to use a water repellent sheet having higher specular reflection ratio and higher gloss level than plain paper used as a recording medium into which ink can penetrate.

Figure 33:
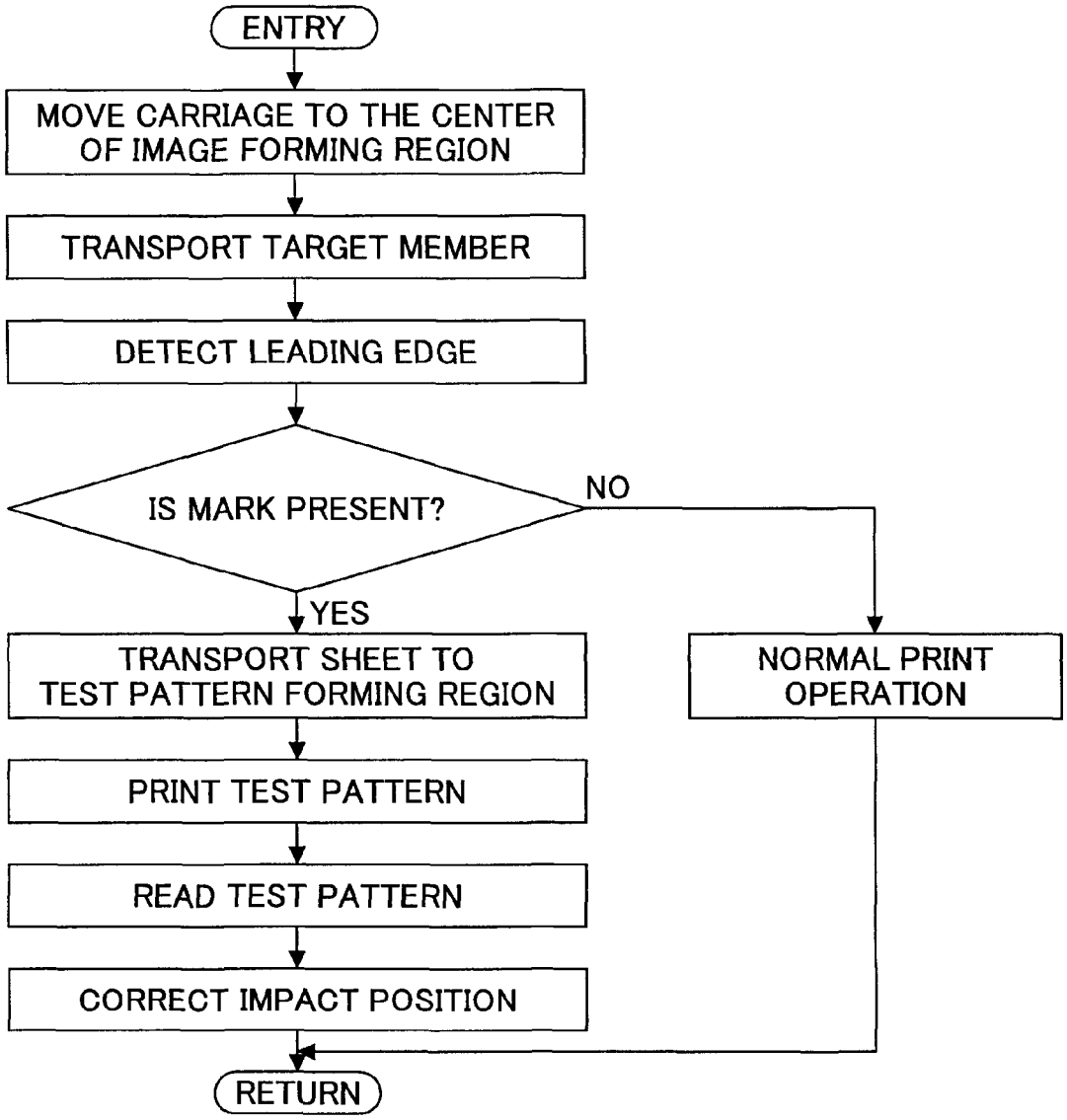
FIG. 33 is a flowchart illustrating liquid droplet impact position detection and liquid droplet impact position adjustment using the water repellent sheet of FIG. 32.

The following describes an operation of correcting the impact position in the case where this water repellent sheet 700A is used with reference to FIG. 33.

First, for detecting a leading edge of a member being transported (target member), the carriage 23 is moved to the center of the image forming region in the main scanning direction, and the target member is transported. Thus the sheet detection sensor 330 detects the leading edge of the target member. It is determined whether a mark 703 is detected. If a mark 703 is not detected, the target member is determined as a usual recording medium, and a normal print operation is performed.

If a mark 703 is detected upon the leading edge detection, the target member is determined to be a water repellent sheet 700. Then the water repellent sheet 700 is transported to the adjustment pattern forming region (test pattern forming region), and a test pattern 400 is printed. The pattern reading sensor 401 reads the test pattern 400, and the impact position displacement amount is calculated. Based on the calculated displacement amount, an impaction position correction of changing the timing of ejecting liquid droplets is performed.

When detecting the leading edge of the target member, if the target member is determined to be a water repellent sheet, an impact position correcting operation may be automatically started. This configuration simplifies user operations required for performing an impact position correction.

Figure 34:
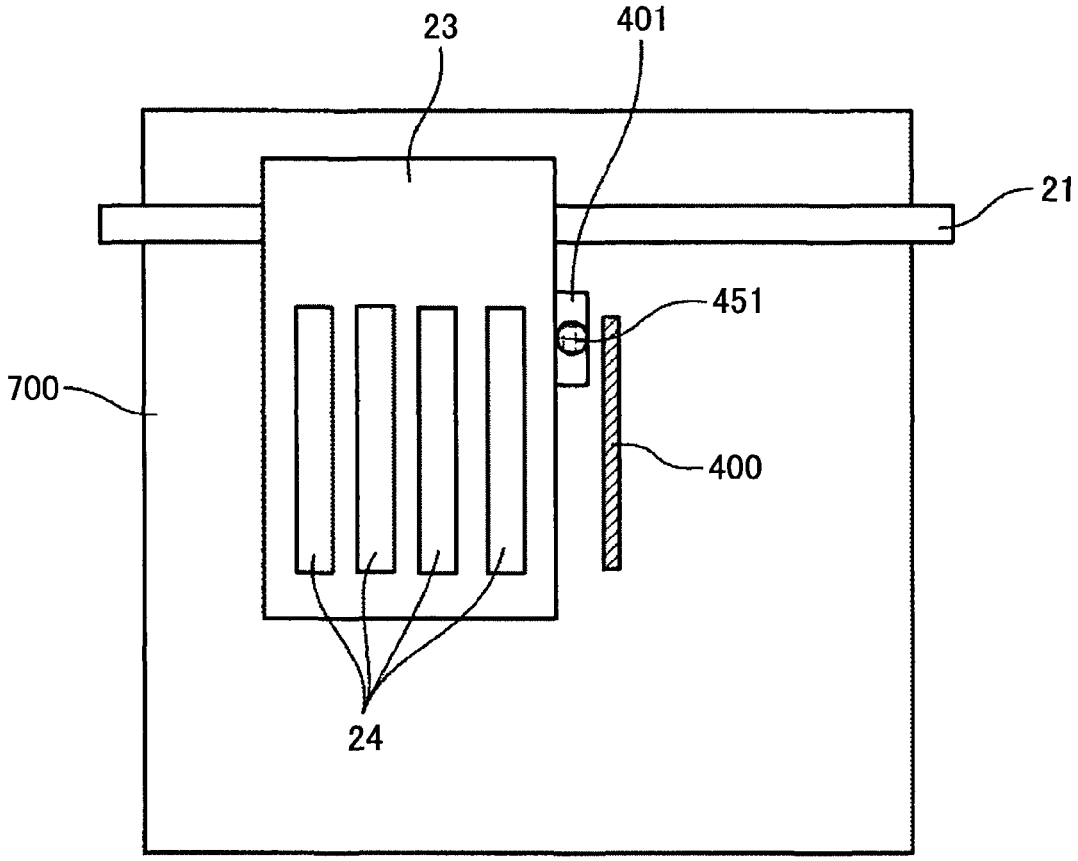
FIG. 34 is a diagram for explaining a pattern reading sensor attachment position on a carriage.

The following describes the attachment position of the above-described reading unit (pattern reading sensor 401) to the carriage 23 in the image forming apparatus that performs above-described impact position displacement correction with reference to FIG. 34 and the subsequent drawings. In the drawings, a four-head configuration is illustrated.

The pattern reading sensor 401 is disposed on the carriage 23 (herein, mounted on the side surface of the carriage 23) and is arranged (attached) near the guide rod 21 as a main guide member for guiding the movement of the carriage 23.

This configuration reduces an adverse effect due to rotation of the carriage 23 about the guide rod 21 when moving the carriage 23.

Figure 35B:
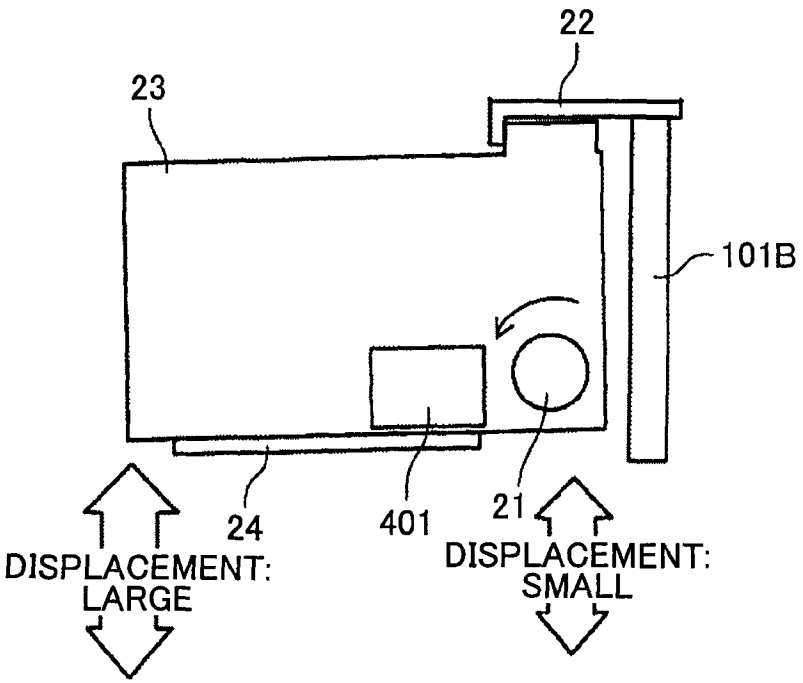
FIGS. 35A and 35B are diagrams for explaining inclination of a carriage.
Figure 35A:
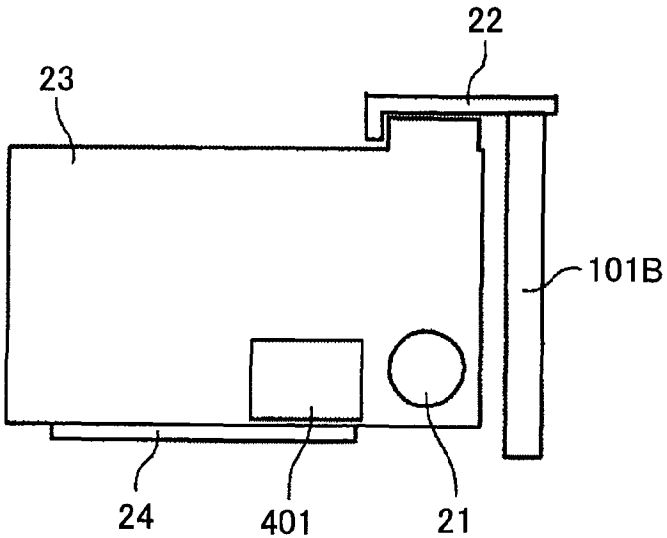

More specifically, when the carriage 23 is moved in the main scanning direction guided by the guide rod 21 as the main guide member and the guide stay (guide rail) 22 as the sub guide member as shown in FIG. 35A, the carriage 23 may be rotated and tilted in the direction as shown in FIG. 35B due to wear of the contact portion of guide stay 22 or excess play. Depending on the engagement situation, the carriage 23 may be tilted in the opposite direction.

Figure 36B:
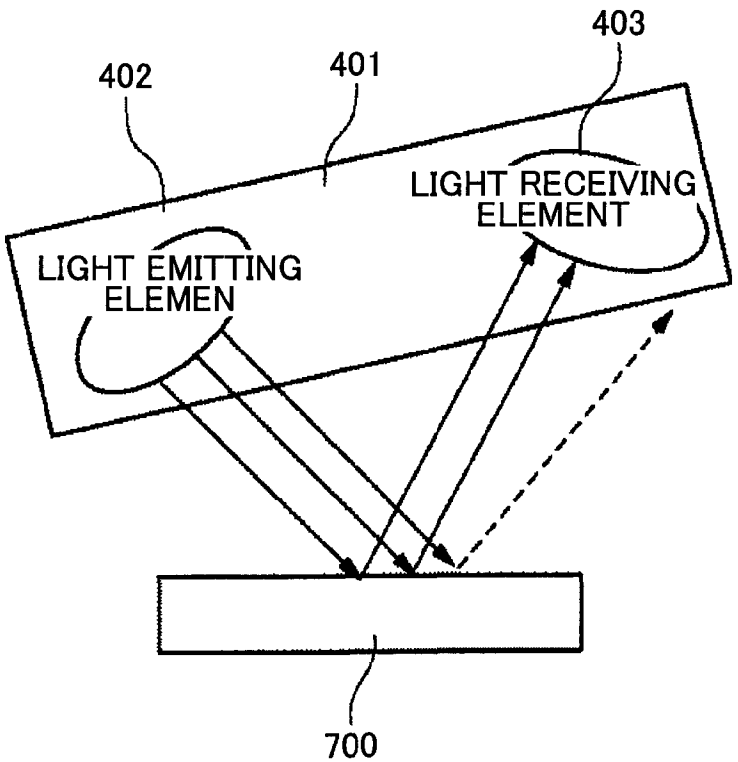
FIGS. 36A and 36B are diagrams for explaining a relationship between inclination of a carriage and the amount of specular reflection light incident on a pattern reading sensor.
Figure 36A:
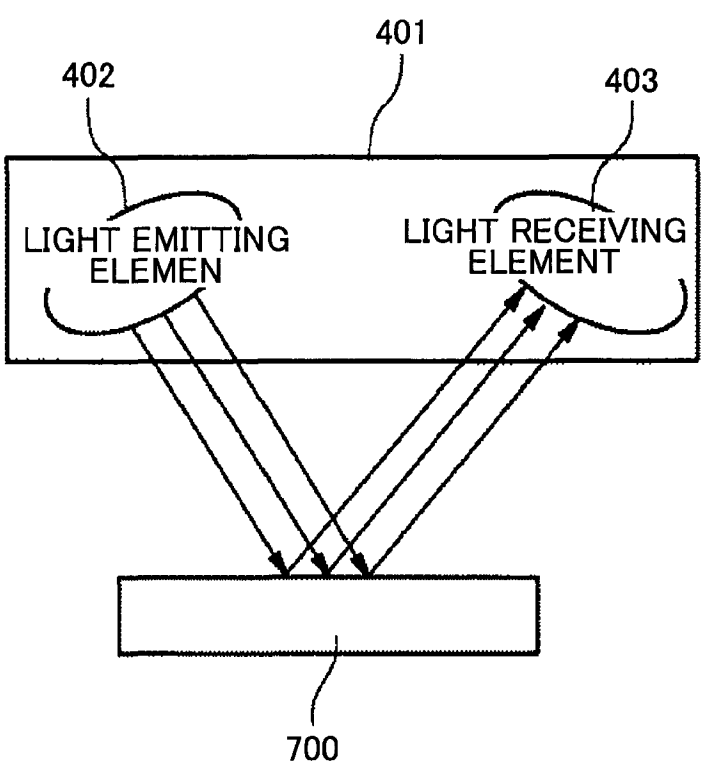

If the carriage 23 is not tilted as shown in FIG. 36A, the specular reflection light from the water repellent sheet 700, on which the light from the light emitting element 402 of the pattern reading sensor 401 mounted on the carriage 23 is incident, is received by the light receiving element 403. However, if the carriage 23 is tilted as shown in FIG. 36B, the pattern reading sensor 401 is tilted, so that a part of the specular reflection light from the water repellent sheet 700 is not incident on (is not received by) the light receiving element 403. Thus, if the carriage 23 is rotated about the guide rod 21 while moving the carriage 23, the height and angle of the pattern reading sensor 401 vary, so that the amount of the specular reflection light incident on the light receiving element 403 fluctuates.

As described above, because the reading operation of the adjustment pattern 400 (impact position detection) of this embodiment of the present invention is performed based on the damping signal of the specular reflection light incident on the light receiving element 403 of the pattern reading sensor 401, the fluctuation of the amount of the specular reflection light incident on the light receiving element 403 adversely affects the detection accuracy. In the case where the pattern reading sensor 401 is arranged near the guide rod 21 as described above, if the carriage 23 is rotated during a reading operation, the change in the height and the angle of the pattern reading sensor 401 is small, and it is therefore possible to maintain high detection accuracy (reading accuracy).

Figure 37:
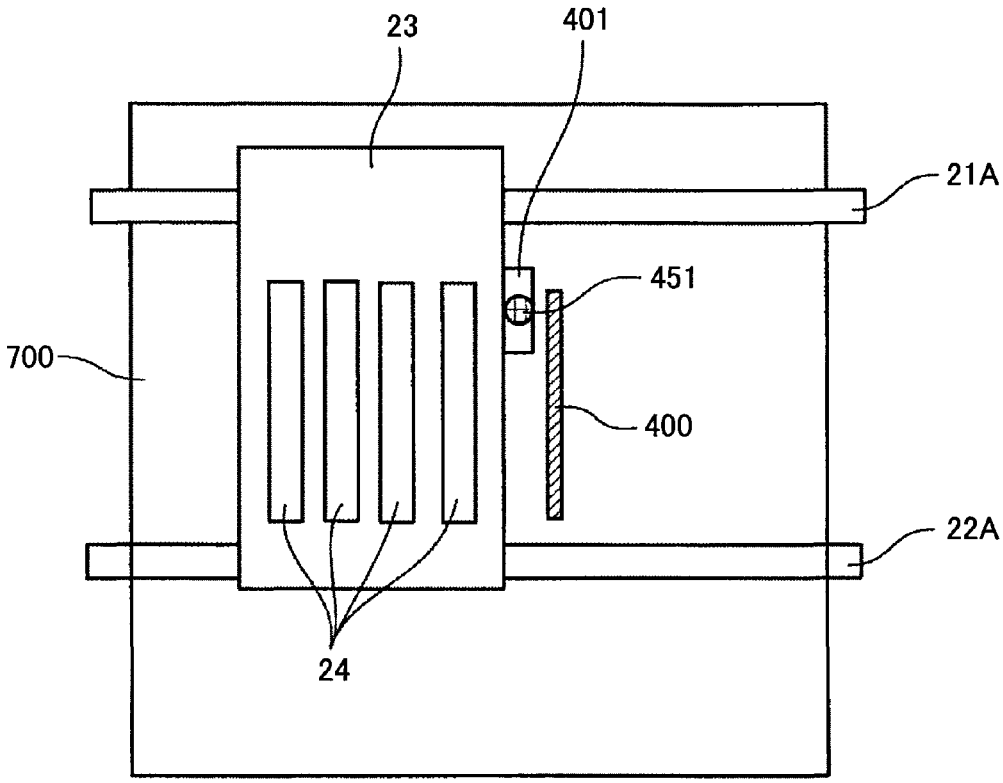
FIG. 37 is a diagram for explaining a pattern reading sensor attachment position on a carriage.

In this example, the carriage 23 is supported at one side (at one end in the sub scanning direction). The carriage 23 may be supported by a main guide member (main guide rod) 21A and a sub guide member (which may be a rod or a stay) 22A at opposite ends as shown in FIG. 37. In such a case, the pattern reading sensor 401 is disposed nearer to the main guide member 21A, which more tightly limits excess play, to attain the same effect.

Figure 38:
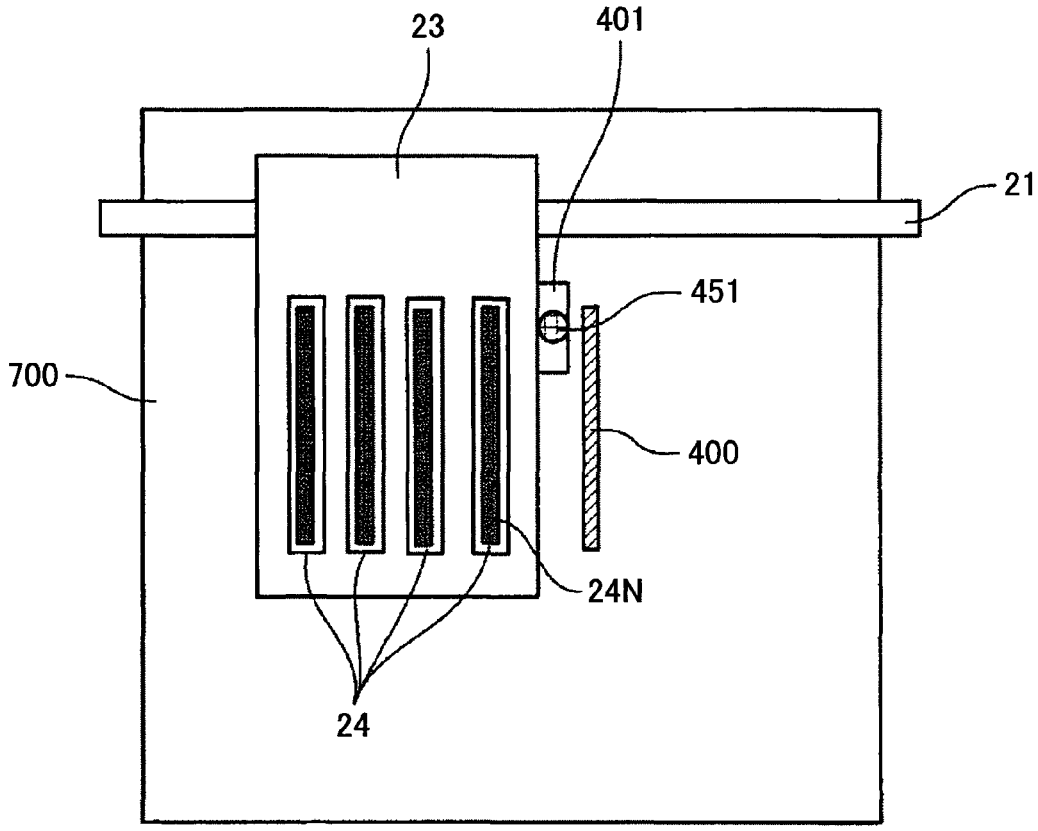
FIG. 38 is a diagram for explaining a relationship between the focus area of a pattern reading sensor and nozzle arrays.

Next, a relationship between the focus area of the pattern reading sensor 401 and nozzle arrays (arrays of nozzles) of the recording heads 24 is described with reference to FIG. 38.

The pattern reading sensor 401 is attached to the carriage 23 such that a focus area 451 is located in the area of the nozzle arrays 24N of the recording heads 24. This configuration makes it possible to read the adjustment pattern 400 by the pattern reading sensor 401 while forming an adjustment pattern 400.

Figure 39:
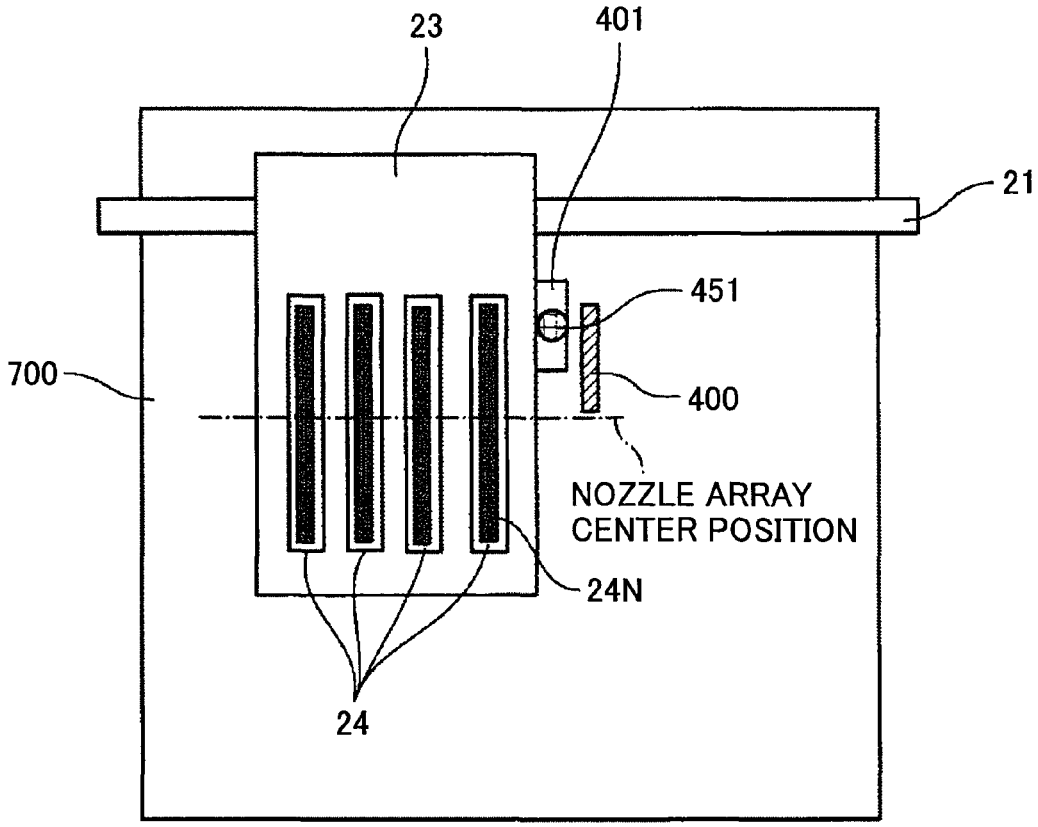
FIG. 39 is a diagram for explaining a relationship between the focus area of a pattern reading sensor and the nozzles to be used for forming an adjustment pattern.

Next, the nozzle array area of the recording heads 24 that form the adjustment pattern 400 is described with reference to FIG. 39.

The adjustment pattern 400 is formed by using nozzle array portions (nozzles) of the nozzle arrays 24N of the recording heads 24 at the side of the guide rod 21 with respect to an imaginary line passing through the center positions of each of the nozzle arrays 24N. By doing so, it is possible to reduce adverse effects due to inclination of the carriage 23 in the direction parallel to the guide rod 21 on the detection accuracy.

For example, if the carriage 23 is inclined in the direction parallel to the guide rod 21 due to the contact with the guide rod 21 while moving the carriage 23, the inclination direction of the carriage 23 in the forward path is opposite to the inclination direction in the backward path. Therefore, the greater the distance from the guide rod 21, the greater is the inclination of the adjustment pattern 400 between the forward path and the backward path, so that it becomes impossible to accurately detect the pattern-to-pattern distance. Therefore, by forming the adjustment pattern 400 using nozzles close to the guide rod 21 and detecting the adjustment pattern 400, it is possible to perform accurate detection. This configuration prevents the formation region (area) of the adjustment pattern 400 from being wastefully big, so that it is possible to reduce the amount of ink to be used for correcting the impact position displacement.

Figure 40:
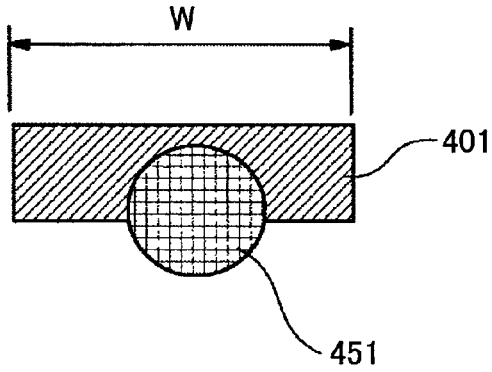
FIG. 40 is a diagram for explaining a relationship between a pattern reading sensor focus area and the size of an adjustment pattern in a main scanning direction.
Figure 41:
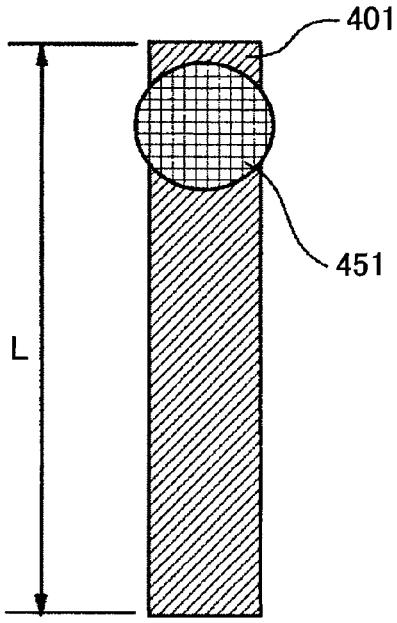
FIG. 41 is a diagram for explaining a relationship between the focus area of a pattern reading sensor and the size of an adjustment pattern in a sub scanning direction.

Next, a relationship between the focus area of the pattern reading sensor 401 and the size (width and length) of the adjustment pattern 400 in the main scanning direction and the sub scanning direction with reference to FIGS. 40 and 41. The adjustment pattern 400A has a width W in the main scanning direction and a length L in the sub scanning direction, which are greater than the focus area of the pattern reading sensor 401. Therefore, the voltage drop of the pattern reading sensor 401 at the position where the pattern is present is maximized, thereby enhancing the detection accuracy.

Next, the number of pattern reading sensors 401 and the layout are described with reference to FIGS. 42 and 43.

In the example shown in FIG. 42, one pattern reading sensor 401 is attached. In this case, the pattern reading sensor 401 is disposed upstream relative to the direction in which the carriage 23 moves when forming the adjustment pattern 400.

Figure 42B:
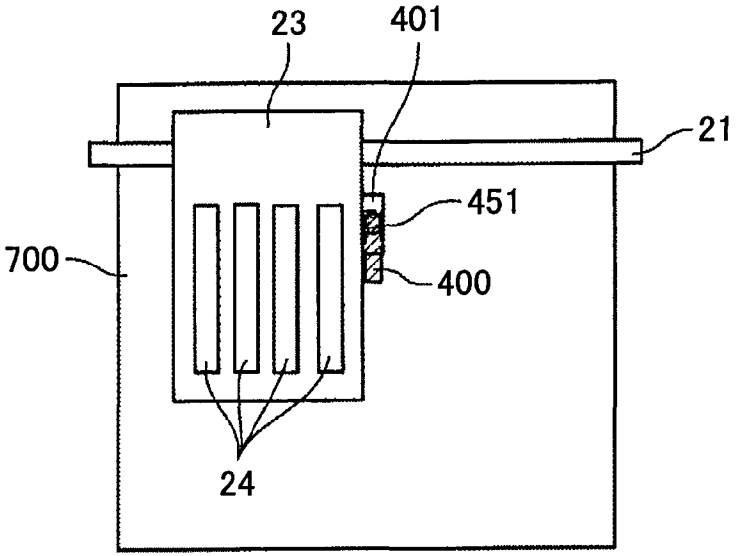
FIGS. 42A and 42B are diagrams each showing a pattern reading sensor attached to a carriage.
Figure 42A:
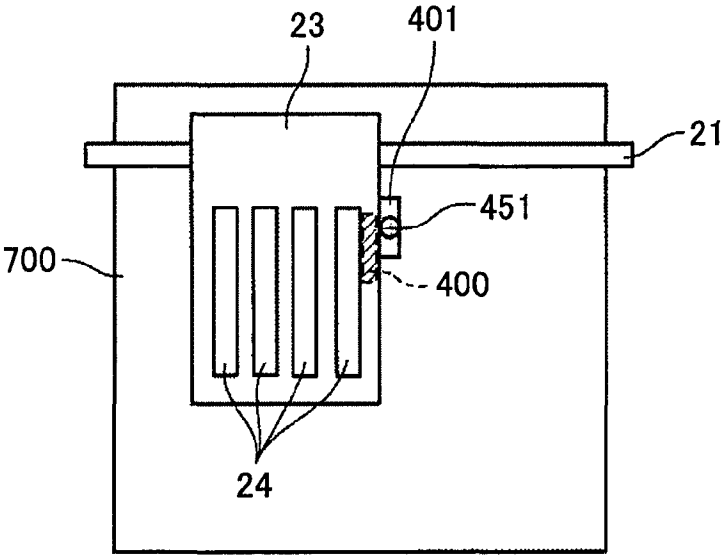

With this configuration, immediately after the adjustment pattern 400 is formed by the recording head 24 as shown in FIG. 42A, the formed adjustment pattern 400 can be read by the pattern reading sensor 401 as shown in FIG. 42B. As mentioned above, because ink dries with time and changes its shape, reducing the time from formation of the adjustment pattern 400 to reading the adjustment pattern 400 improves the detection accuracy.

Figure 43:
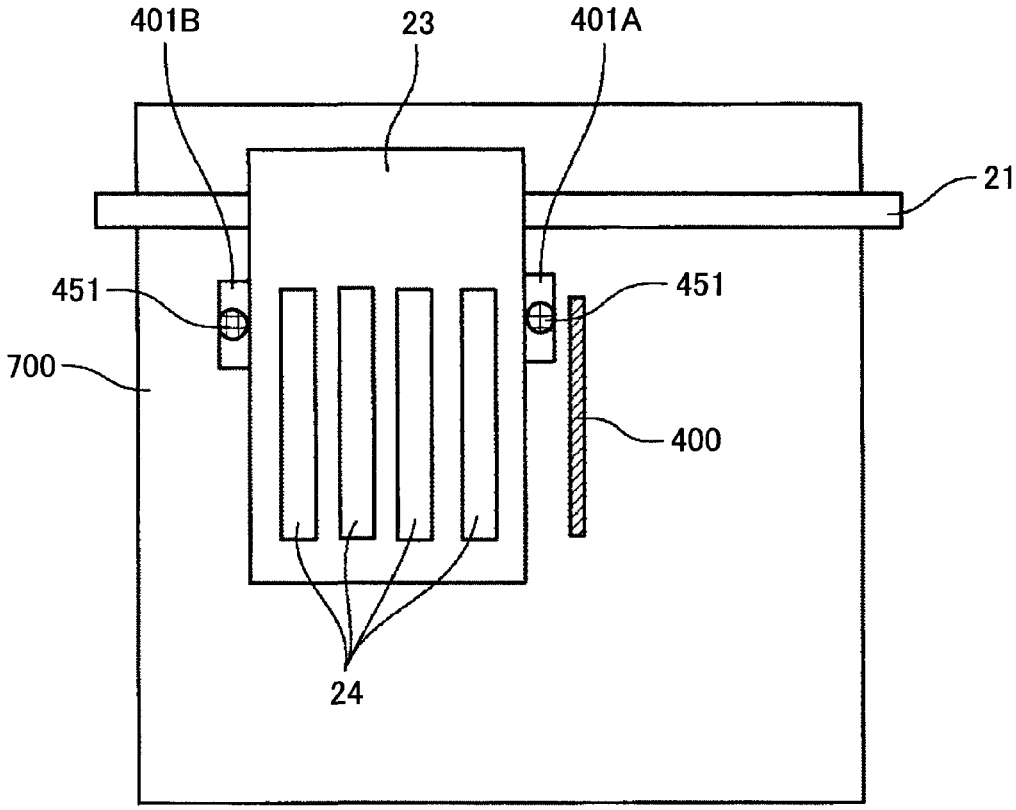
FIG. 43 is a diagram showing two pattern reading sensors attached to a carriage.

Referring to FIG. 43, first and second pattern reading sensors 401A and 401B are attached to the opposite sides of the carriage 23. With this configuration, the adjustment pattern 400 can be read immediately after forming the adjustment 400 in both cases where the adjustment pattern 400 is formed in the forward path and where the adjustment pattern 400 is formed in the backward path. Therefore, the time from formation of the adjustment pattern 400 to reading the adjustment pattern 400 is reduced, thereby improving the detection accuracy.

Figure 44:
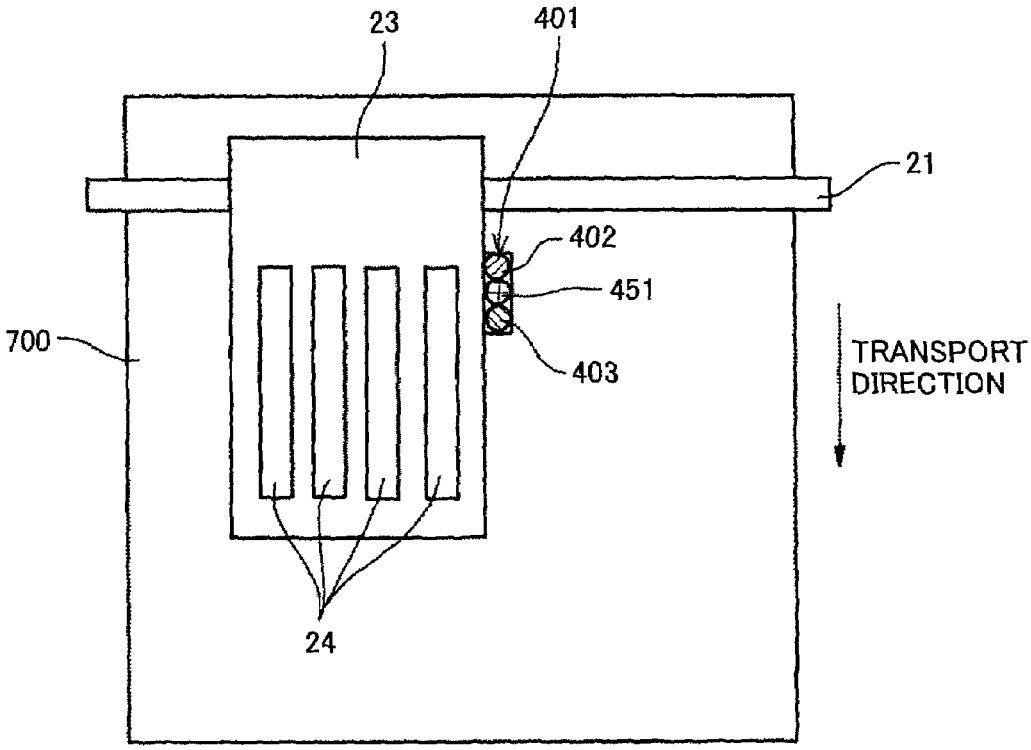
FIG. 44 is a diagram for explaining a pattern reading sensor attachment position on a carriage.

Next, the attachment direction of the pattern reading sensor 401 is described with reference to FIG. 44.

The pattern reading sensor 401 is attached such that the light emitting element 402 and the light receiving element 403 are aligned in the direction orthogonal to the moving direction of the carriage 23. This configuration can reduce adverse effects due to the moving speed of the carriage 23.

Next, used of a photo sensor serving both as the pattern reading sensor 401 and the sheet detection sensor (leading edge detection sensor) 330 is described below.

In the above described embodiment, the pattern reading sensor 401 and the sheet detection sensor (leading edge detection sensor) 330 are separate sensors. In this embodiment of the present invention, because the adjustment pattern 400 are formed of independent liquid droplets as described above, the adjustment pattern 400 can be read by receiving the specular reflection light by the light receiving element 403. Therefore, a single photo sensor may be used that serves both as the pattern reading sensor 401 and the sheet detection sensor (leading edge detection sensor) 330. This can simplify the configuration and achieves a cost reduction.

Next, other attachment positions of the pattern reading sensor 401 to the carriage 23 are described with reference to FIG. 45.

Figure 45:
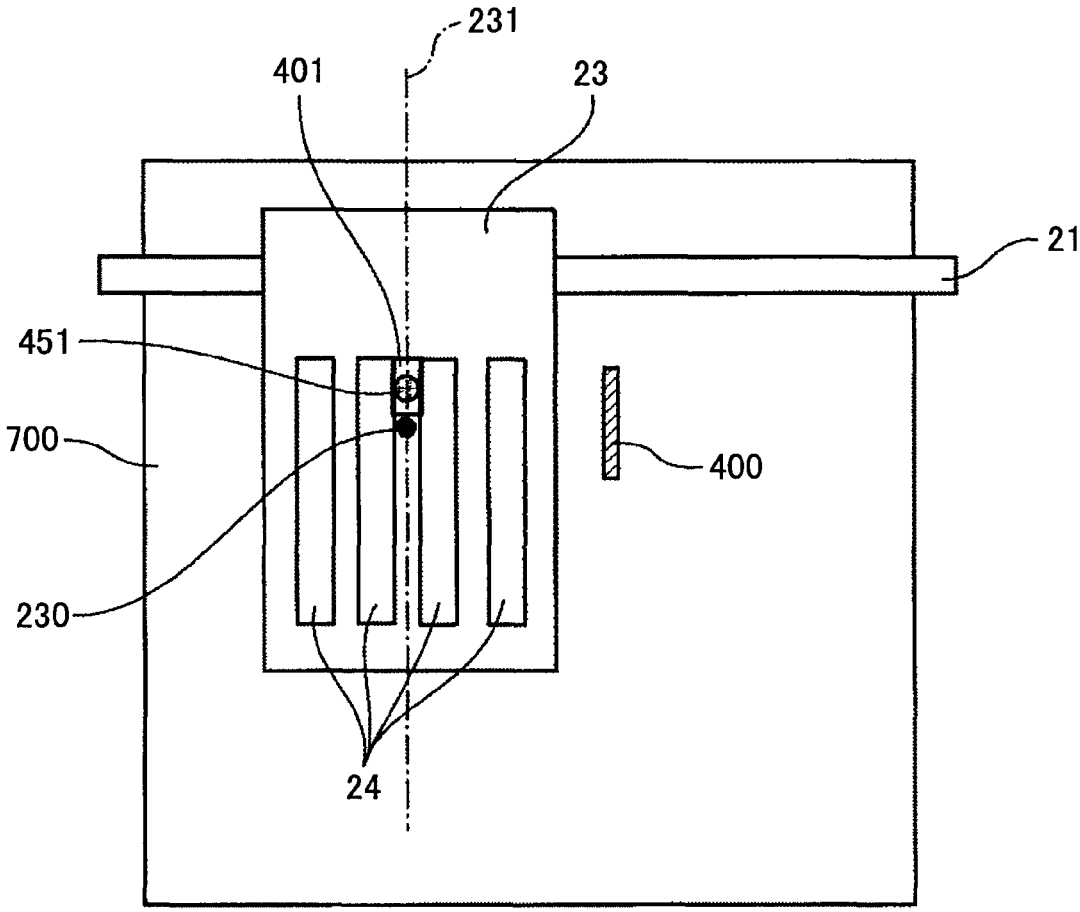
FIG. 45 is a diagram for explaining a pattern reading sensor attachment position on a carriage.
Figure 46:
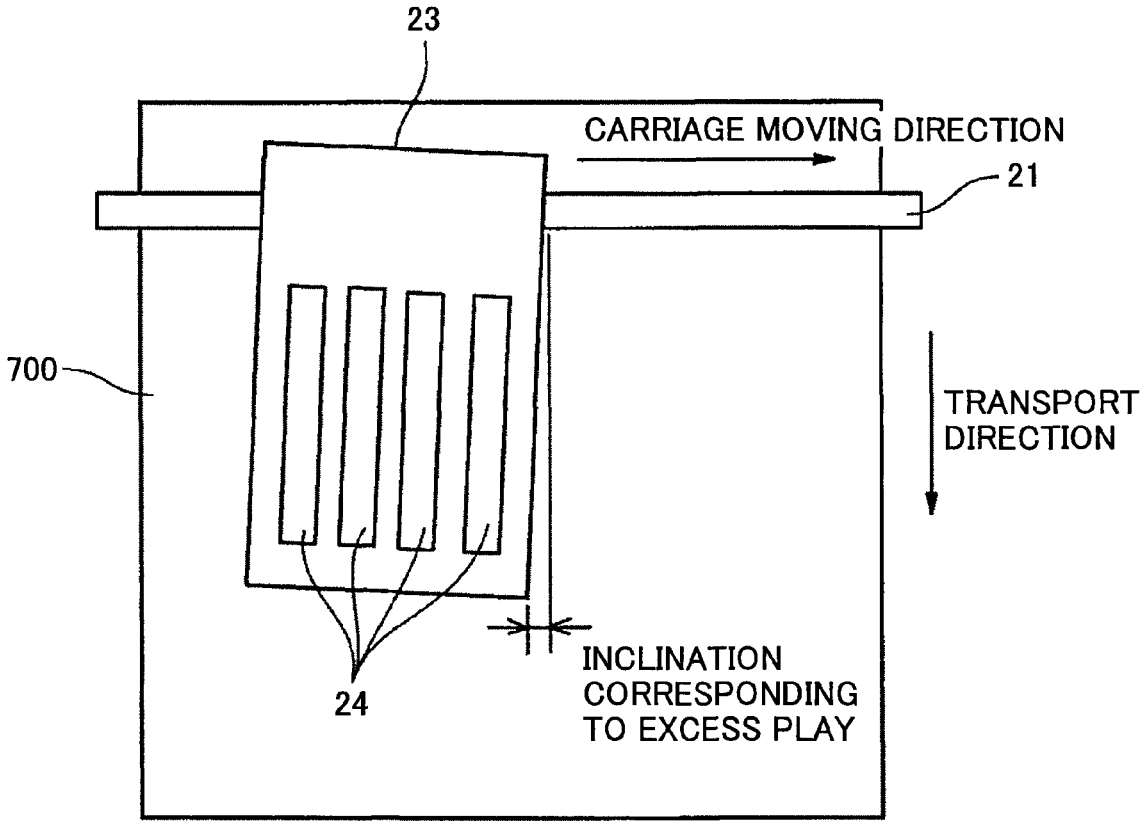
FIG. 46 is a plan view for explaining inclination of a carriage in a main scanning direction.

In the example shown in FIG. 45, the pattern reading sensor 401 is disposed on a line 231 passing a centroid 230 of the carriage 23 in the main scanning direction. Thus a variation between the forward path and the backward path resulting from the adverse effects due to the rotation of the carriage 23 in the direction parallel to the guide rod 21 during the movement of the carriage 23 in the main scanning direction can be reduced.

That is, as described above, when the carriage 23 is moved in the main scanning direction through the timing belt 29, because the carriage 23 is moved by the timing belt 29, if there is unwanted play between the guide rod 21 and the carriage 23, the carriage 23 is rotated and inclined in the direction opposite to the direction in which the carriage 23 is moved by the timing belt 29. The direction of the inclination in the forward path is opposite to the direction of the inclination in the backward path. Even if the inclination direction of the carriage 23 in the forward path is opposite to the inclination direction in the backward path as described above, because the pattern reading sensor 401 is located on the line 231 passing through the centroid 230 of the carriage 23 in the main scanning direction and therefore the pattern sensor 40*a* is located substantially in the same position when in the forward path and when in the backward path, it is possible to reduce variation between the forward path and the backward path.

Figure 47:
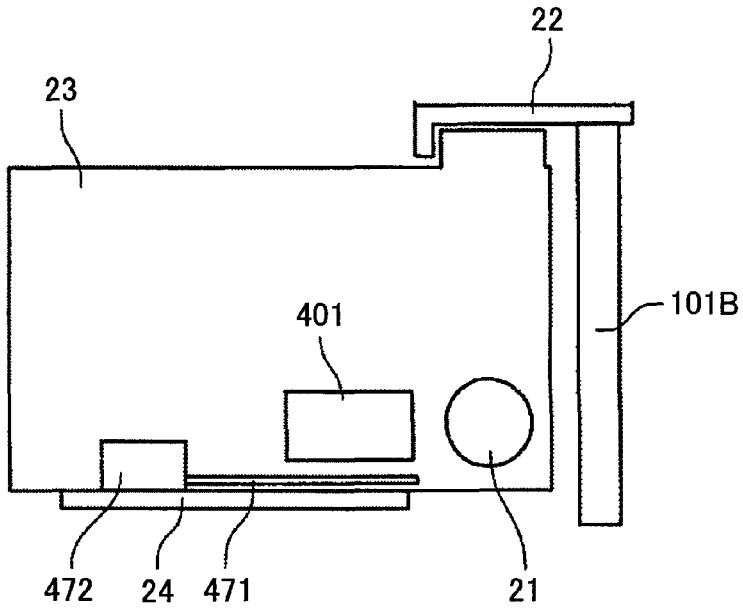
FIG. 47 is a side view showing an example in which a protection member for a pattern read sensor is provided.
Figure 48:
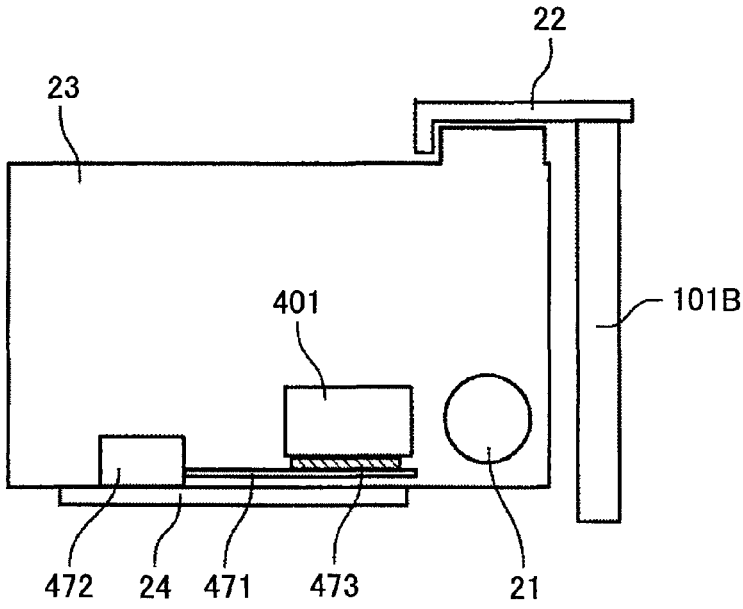
FIG. 48 is a side view showing another example in which a protection member for a pattern read sensor is provided.

Next, protection of the pattern reading sensor 401 is described with reference to FIGS. 47 and 48.

In this example, a sensor cover 471 that covers a sensor surface (a light emitting/receiving surface) of the pattern reading sensor 401 is horizontally movable by a cover driving solenoid 472. Only when using the pattern reading sensor 401, the sensor cover 471 is slid to expose the sensor surface of the pattern reading sensor 401. This configuration can prevent reduction of the detection accuracy due to contamination of the pattern reading sensor 401, which is not always used, by ink mist or the like.

In this case, a cleaning member 473 such as sponge that cleans the sensor surface of the pattern reading sensor 401 may be provided on the inner side of the sensor cover 471. By cleaning the sensor surface of the pattern reading sensor 401, it is possible to perform consistent detection (reading) operations.

Figure 49:
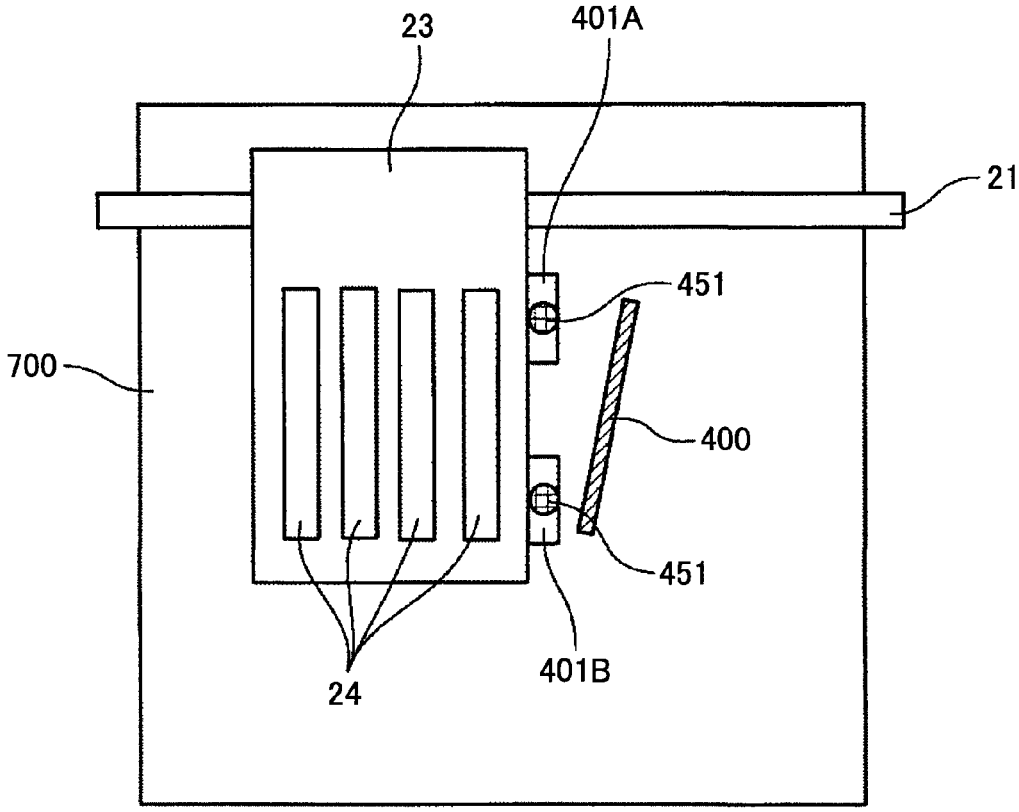
FIG. 49 is a diagram showing two pattern reading sensors attached to a carriage.

Next, another example of the number of pattern reading sensors 401 and the layout is described with reference to FIG. 49.

In this example, two pattern reading sensors, namely the first pattern reading sensor 401A and the second pattern reading sensor 401B, are disposed in different positions in the sub scanning direction on one side of the carriage 23. With this configuration, it is possible to detect the adjustment pattern 400 even if the adjustment pattern 400 is inclined as shown in FIG. 49. Therefore, for example, it is possible to compensate for inclination of the carriage 23 during image formation by adjusting the ejection timings of the nozzles. Although, in FIG. 49, the second pattern reading sensor 401B is spaced away from the guide rod 21 for illustration purpose, the second pattern reading sensor 401B is preferably located in a position closer to the guide rod 21 as mentioned above.

Figure 50:
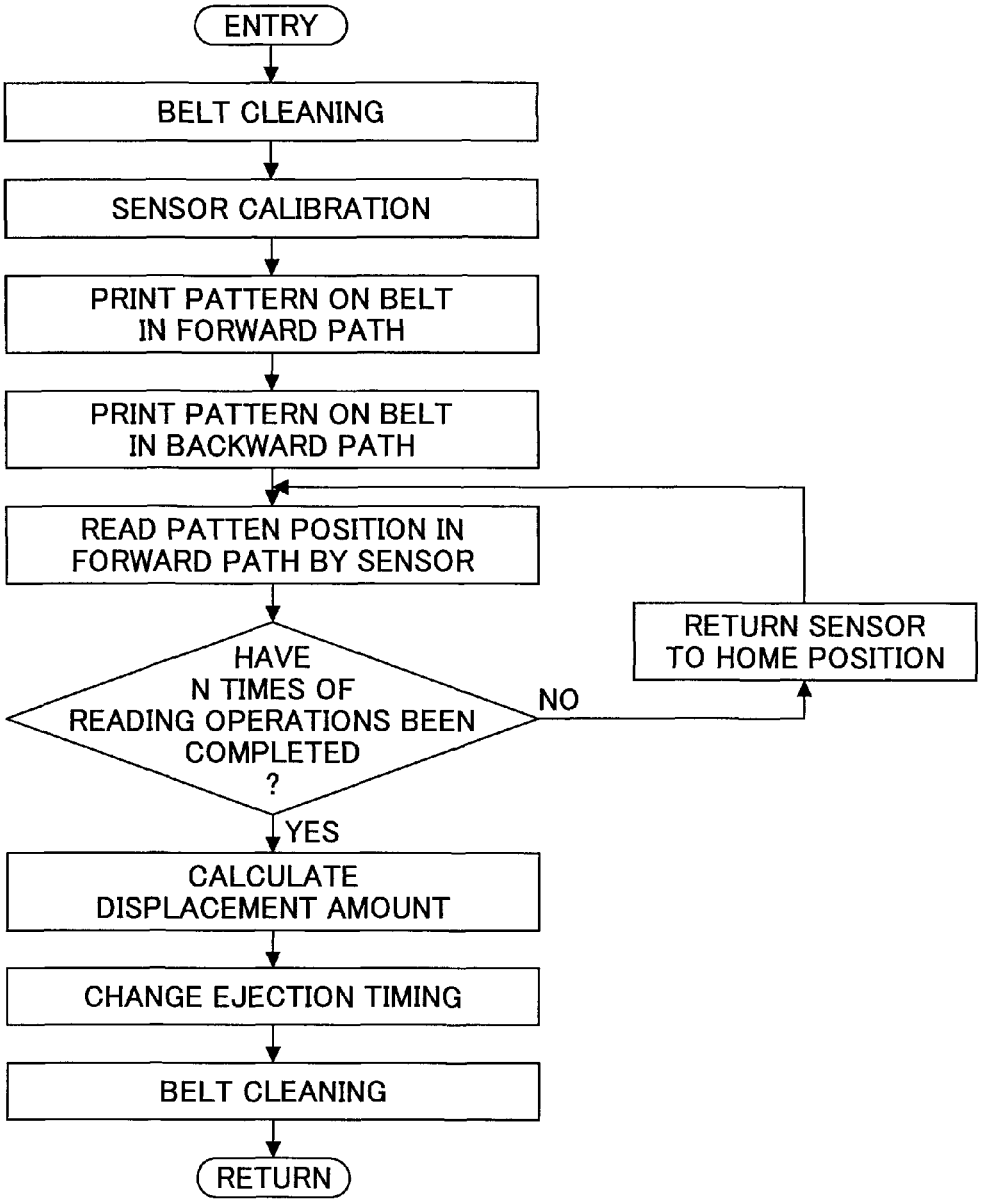
FIG. 50 is a flowchart illustrating liquid droplet impact position detection and liquid droplet impact position adjustment by forming an adjustment pattern on a transport belt.

The following describes an operation of correcting impact position displacement performed by the main control unit 310 in the case where an adjustment pattern is formed on a water repellent transport belt 31 as a water repellent member with reference to FIG. 50.

For example, an ink droplet impact position displacement adjustment operation may be performed after completion of a cleaning operation for maintenance and recovery of the recording heads 24*k*1 and 24*k*2 using black ink (K1 or K2); after completion of a cleaning operation for an apparatus not in use for a predetermined time period; and when the amount of change in the environmental temperature is greater than a predetermined amount.

An operation of cleaning the transport belt 31 is performed, and then calibration of the pattern reading sensor 401 is performed. Thus the output of the light emitting element 402 is adjusted such that the output level of the specular reflection of the pattern reading sensor 401 (the light emitting element 402 and the light receiving element 403) of the carriage 23 becomes a constant value on the transport belt 31.

Figure 31:
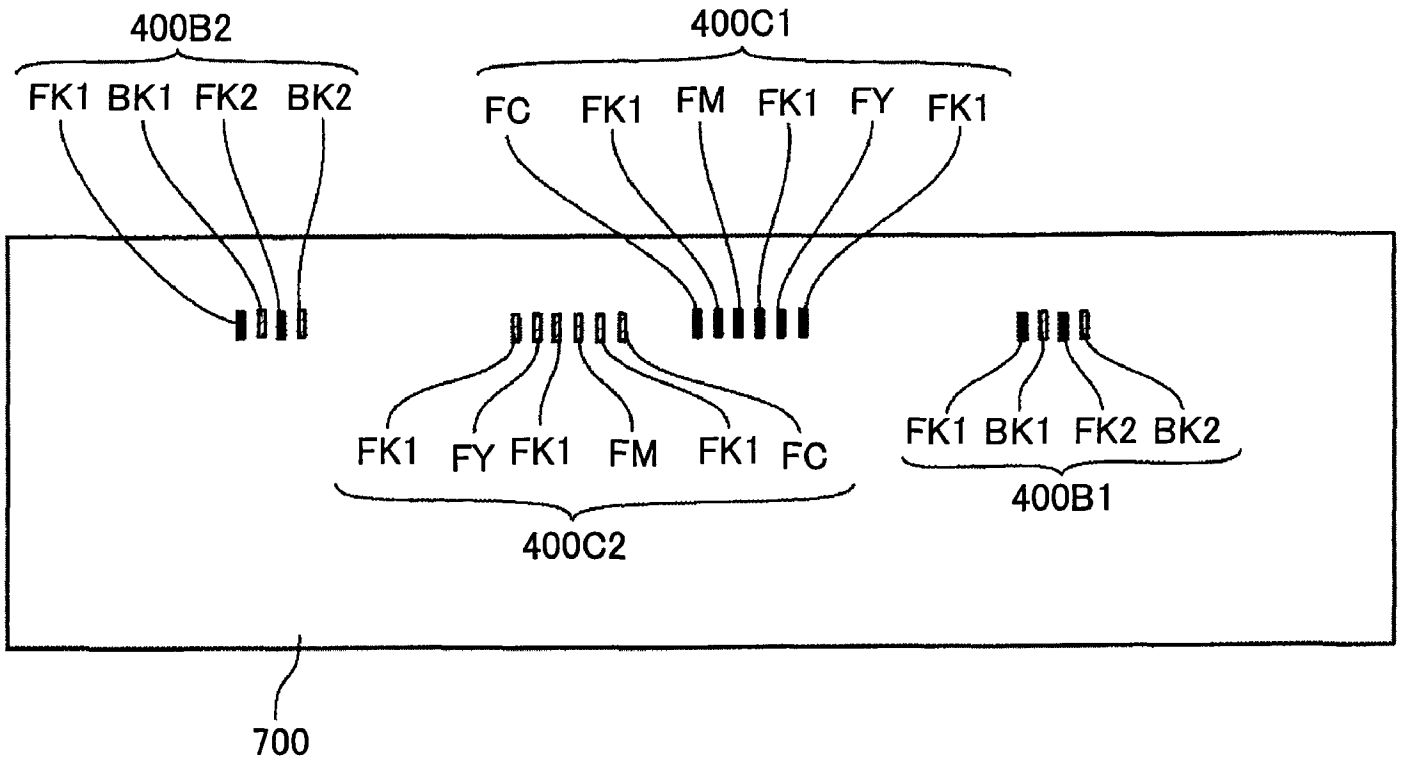
FIG. 31 is a diagram for explaining an example of forming adjustment patterns.

Then, while moving the carriage 23 in the forward path in the main scanning direction, the recording heads 24 eject liquid droplets to form, on the transport belt 31, line-shaped patterns of the adjustment pattern 400 of FIG. 31 to be formed in the forward path. While forming the patterns, the carriage 23 is moved at the same linear velocity as the writing linear velocity. Then, while moving the carriage 23 in the backward path in the main scanning direction, the recording heads 24 eject liquid droplets to form, on the transport belt 31, line-shaped patterns of the adjustment pattern 400 of FIG. 31 to be formed in the backward path.

Then, the light emitting element 402 of the pattern reading sensor 401 emits light, and the adjustment pattern 400 is read by moving the carriage 23 in the forward path in the main scanning direction. The impact positions are detected based on the output of the light receiving element 403 of the pattern reading sensor 401. This operation is repeated a predetermined number of times (N times) (in each operation, reading is performed in the forward path direction) to obtain the results of N times of impact position detections.

Based on the impact position detection results obtained by the reading operations, the average value of the displacement amount of the liquid droplet impact position is calculated. Based on the calculated average value of the displacement amount, a correction amount for correcting the liquid droplet ejection timing is calculated. The liquid ejection timing is corrected based on the calculated liquid droplet ejection timing correction amount. After that, a cleaning operation for cleaning the surface of the transport belt 31 is performed.

As described above, an impact position adjustment pattern formed of plural independent liquid droplets on a transport belt as a water repellent member. A light emitting unit emits light onto the adjustment pattern, and a light receiving element receives specular reflection light from the adjustment pattern, thereby reading the adjustment pattern. Based on the read result of the adjustment pattern, the impact position of a liquid droplet to be ejected from a recording head is corrected. Thus, it is possible to accurately detect the impact positions of the liquid droplets with a simple configuration and accurately correct displacement of the liquid droplet impact position.

In the case where an adjustment pattern is formed on the transport belt 31 as a water repellent member, the principal of detecting the adjustment pattern is applicable (i.e., the same explanation is applicable by replacing the water repellent sheet 700 in the drawings with the transport belt 31).

The present application is based on Japanese Priority Application No. 2007-069681 filed on Mar. 17, 2007, with the Japanese Patent Office, the entire contents of which are hereby incorporated by reference.

What is claimed is:

1. An image forming apparatus that is provided with a carriage in which recording heads having nozzles for ejecting liquid droplets are mounted and is configured to form an image on a recording medium being transported, the image forming apparatus comprising:

a pattern forming unit that forms an impact position displacement adjustment pattern formed of plural independent liquid droplets on a water repellent member;

a reading unit that includes a light emitting unit for emitting light onto the adjustment pattern and a light receiving unit for receiving specular reflection light from the adjustment pattern; and an impact position correcting unit that corrects an impact position of a liquid droplet to be ejected from the recording head based on a read result by the reading unit;

wherein the reading unit is disposed on the carriage and is arranged close to a guide member that guides movement of the carriage, and wherein the reading unit is disposed at a centroid of the recording heads in a recording head moving direction.

2. The image forming apparatus as claimed in claim 1, wherein the adjustment pattern is formed by the nozzles at the side of the guide member with respect to an imaginary line passing through the center positions of arrays of the nozzles of the recording heads.

3. The image forming apparatus as claimed in claim 1, wherein a width of the adjustment pattern in a carriage moving direction is greater than a focus area of the reading unit.

4. The image forming apparatus as claimed in claim 1, wherein a length of the adjustment pattern in a direction orthogonal to a carriage moving direction is greater than a focus area of the reading unit.

5. The image forming apparatus as claimed in claim 1, wherein the reading unit is disposed upstream relative to a direction in which the carriage moves when forming the adjustment pattern.

6. The image forming apparatus as claimed in claim 1, wherein plural of the reading units are disposed on opposite sides of the carriage.

7. The image forming apparatus as claimed in claim 1, wherein the light emitting unit and the light receiving unit of the reading unit are aligned in a direction orthogonal to a recording head moving direction.

8. The image forming apparatus as claimed in claim 1, wherein the reading unit serves as a detecting unit that detects a leading edge of the recording medium.

9. The image forming apparatus as claimed in claim 1, further comprising:

a cover that covers the reading unit.

10. An image forming apparatus as claimed in claim 9, wherein the cover includes a cleaning unit that cleans a surface of the reading unit.

11. The image forming apparatus as claimed in claim 1, wherein plural of the reading units are disposed in a direction parallel to arrays of the nozzles of the recording heads.

* * * * *